US009410714B2

(12) United States Patent
Tsuji

(10) Patent No.: US 9,410,714 B2
(45) Date of Patent: Aug. 9, 2016

(54) CONTROLLER AND AIR CONDITIONER

(75) Inventor: Kaichi Tsuji, Kusatsu (JP)

(73) Assignee: Daikin Industries, Ltd., Osaka-shi (JP)

( * ) Notice: Subject to any disclaimer, the term of this patent is extended or adjusted under 35 U.S.C. 154(b) by 1105 days.

(21) Appl. No.: 13/504,814

(22) PCT Filed: Oct. 29, 2010

(86) PCT No.: PCT/JP2010/069348

§ 371 (c)(1),
(2), (4) Date: Apr. 27, 2012

(87) PCT Pub. No.: WO2011/052743

PCT Pub. Date: May 5, 2011

(65) Prior Publication Data

US 2012/0220212 A1 Aug. 30, 2012

(30) Foreign Application Priority Data

Oct. 30, 2009 (JP) ..... 2009-251457

(51) Int. Cl.
*F24F 13/10* (2006.01)
*F24F 11/00* (2006.01)
*F24F 1/00* (2011.01)

(52) U.S. Cl.
CPC ..... *F24F 11/0086* (2013.01); *F24F 11/0078* (2013.01); *F24F 2001/0037* (2013.01); *F24F 2011/0091* (2013.01)

(58) Field of Classification Search
CPC ..... F24F 11/0078; F24F 2001/0048; F24F 1/0007; F24F 11/0086; F24F 2011/0091; F24F 2001/0037
USPC ..... 454/256, 292, 333
See application file for complete search history.

(56) References Cited

U.S. PATENT DOCUMENTS

| | | | | | |
|---|---|---|---|---|---|
| 3,166,000 | A | * | 1/1965 | Taylor | 454/256 |
| 3,347,987 | A | | 10/1967 | Chaloupka | |
| 5,072,878 | A | * | 12/1991 | Aoki et al. | 236/38 |
| 5,097,672 | A | * | 3/1992 | Takenaka et al. | 62/186 |
| 5,180,333 | A | * | 1/1993 | Shyu | 454/319 |
| 5,331,825 | A | * | 7/1994 | Kim | 62/180 |
| 5,660,588 | A | * | 8/1997 | Kotoh et al. | 454/285 |
| 5,875,639 | A | * | 3/1999 | Kim et al. | 62/186 |
| 5,899,807 | A | * | 5/1999 | Kim et al. | 454/229 |
| 5,924,923 | A | * | 7/1999 | Chiguchi et al. | 454/256 |
| 6,334,317 | B1 | | 1/2002 | Bougauchi et al. | |

(Continued)

FOREIGN PATENT DOCUMENTS

| | | | |
|---|---|---|---|
| JP | 5-58149 | A | 3/1993 |
| JP | 5-126387 | A | 5/1993 |
| JP | 6-131334 | A | 5/1994 |
| JP | 7-225046 | A | 8/1995 |
| JP | 9-284406 | A | 10/1997 |

(Continued)

*Primary Examiner* — Gregory Huson
*Assistant Examiner* — Dana Tighe
(74) *Attorney, Agent, or Firm* — Birch, Stewart, Kolasch & Birch, LLP

(57) ABSTRACT

A controller configured so that pieces of information relating to each outlet and each flap which are currently set can be collectively visible on the controller. A controller for an indoor unit provided with flaps having substantially the same shape, the flap being respectively disposed at the outlets and capable of individually changing the discharge directions of air-conditioning air. The controller is provided with a display section for simultaneously displaying information relating to an outlet selected out of the outlets and/or information relating to a flap selected out of the flaps.

10 Claims, 22 Drawing Sheets

(56) References Cited

U.S. PATENT DOCUMENTS

| | | | | |
|---|---|---|---|---|
| 6,347,987 | B1 | 2/2002 | Ichishi et al. | |
| 6,685,556 | B1 * | 2/2004 | Bertin | 454/256 |
| 7,130,720 | B2 * | 10/2006 | Fisher | F24F 11/006 236/49.3 |
| 7,185,504 | B2 * | 3/2007 | Kasai | F24F 1/0007 454/292 |
| 8,364,317 | B2 * | 1/2013 | Park et al. | 700/276 |
| 8,392,026 | B2 * | 3/2013 | Matsumoto et al. | 700/276 |
| 2008/0254734 | A1 | 10/2008 | Uenaka et al. | |
| 2009/0057427 | A1 * | 3/2009 | Geadelmann | G05B 15/02 236/51 |
| 2009/0140065 | A1 | 6/2009 | Juntunen et al. | |
| 2009/0326847 | A1 | 12/2009 | Ohta | |

FOREIGN PATENT DOCUMENTS

| | | | |
|---|---|---|---|
| JP | 2000-213793 | A | 8/2000 |
| JP | 2001-12790 | A | 1/2001 |
| JP | 2001-133019 | A | 5/2001 |
| JP | 2002-24423 | A | 1/2002 |
| JP | 2003-139382 | A | 5/2003 |
| JP | 2003-262388 | A | 9/2003 |
| JP | 2005-207705 | A | 8/2005 |
| JP | 2006-336925 | A | 12/2006 |
| JP | 2007-155271 | A | 6/2007 |
| JP | 2008-304084 | A | 12/2008 |
| JP | 4495778 | B1 | 7/2010 |
| WO | WO 2009/041320 | A1 | 4/2009 |
| WO | WO 2011/052742 | A1 | 5/2011 |

* cited by examiner

FIG.10
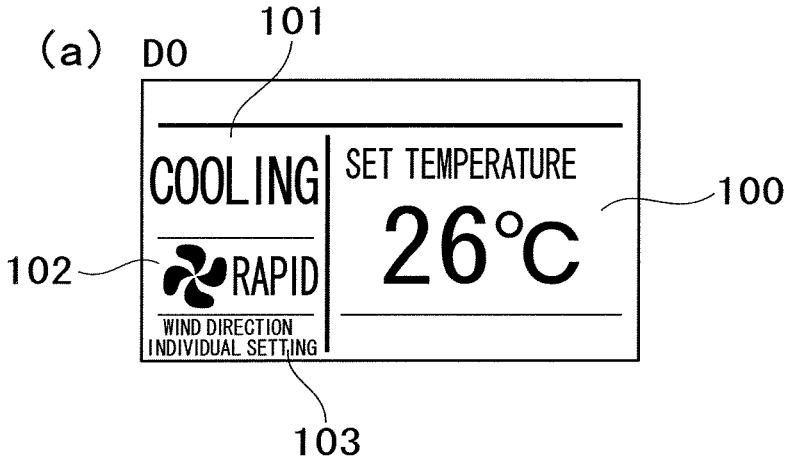
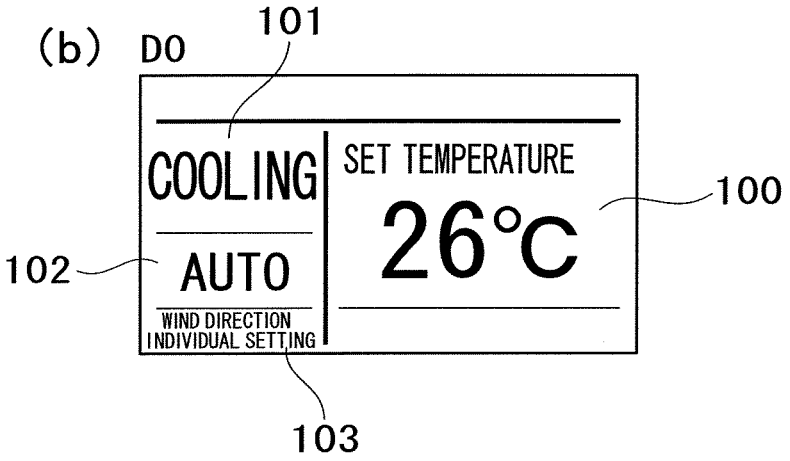

FIG.11
(a) D1
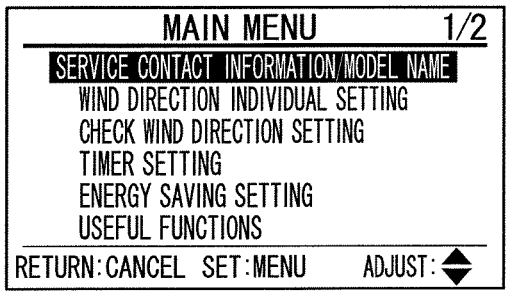
(b) D1
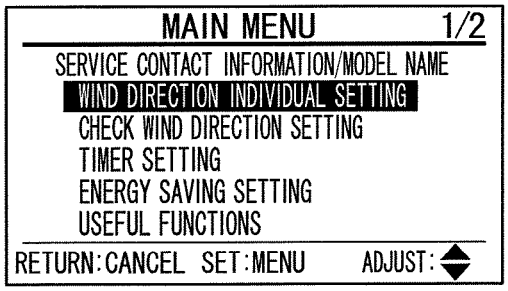

FIG.12
(a) D2-0
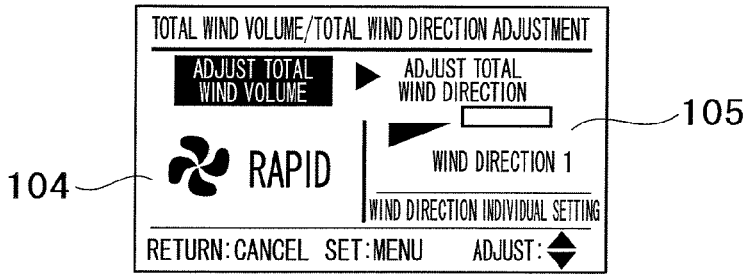
(b) D2-1
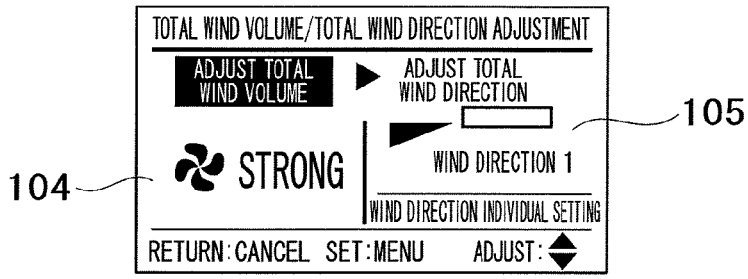
(c) D2-2
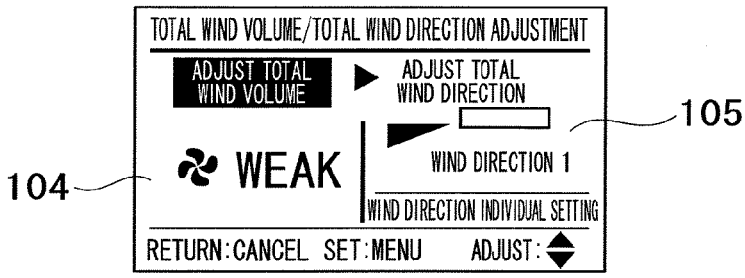
(d) D2-3
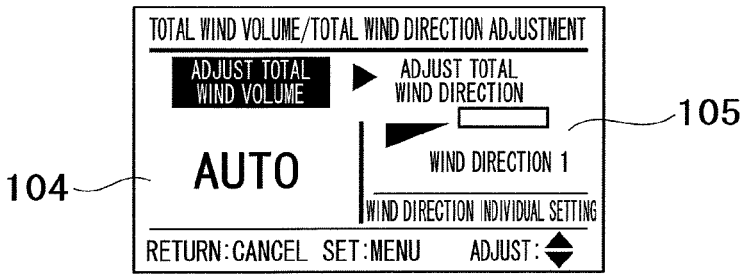

FIG.15

(a) D4

WIND DIRECTION/SETTING CHECK

| OUTLET | WIND DIRECTION | INDIVIDUAL SETTING |
|---|---|---|
| 1 ■ | WIND DIRECTION 2 | |
| 2 ■■ | WIND DIRECTION 2 | |
| 3 ■■■ | WIND DIRECTION 1 | ○ |
| 4 ■■■■ | WIND DIRECTION 2 | |

RETURN:CANCEL OK:MENU INDIVIDUAL WIND DIRECTION:▶

(b) D4

WIND DIRECTION/SETTING CHECK

| OUTLET | WIND DIRECTION | INDIVIDUAL SETTING |
|---|---|---|
| 1 ■ | WIND DIRECTION 2 | |
| 2 ■■ | WIND DIRECTION 2 | |
| 3 ■■■ | WIND DIRECTION 1 | ○ |
| 4 ■■■■ | WIND DIRECTION 3 | ○ |

RETURN:CANCEL OK:MENU INDIVIDUAL WIND DIRECTION:▶

CONTROLLER AND AIR CONDITIONER

TECHNICAL FIELD

The present invention relates to a controller and an air conditioner having the same, the controller being configured to accept operations entered for the air conditioner.

BACKGROUND ART

The ceiling embedded indoor unit has a plurality of outlets for the discharge of air-conditioning air. The outlets have flaps disposed to change the discharge direction of the air-conditioning air (see, for example, Patent Document 1). In this indoor unit, the operation of the flaps is controlled by a single motor.

CITATION LIST

Patent Document

Patent Document 1: JP-A-2005-207705

SUMMARY OF THE INVENTION

Problems to be Solved by the Invention

In an air conditioner that includes the indoor unit having a plurality of flaps respectively disposed at the outlets, it is conceivable to individually control the flaps. In this air conditioner, the wind directions of the plurality of outlets are preferably displayed by the controller so that the user can easily confirm.

It is accordingly an object of the present invention to provide a controller configured so that pieces of information relating to each outlet and each flap which are currently set can be collectively visible, and to provide an air conditioner having such a controller.

Means for Solving the Problems

A first aspect of the present invention is a controller for an indoor unit that includes a plurality of flaps of substantially the same shape respectively disposed at a plurality of outlets, and capable of individually changing the discharge direction of the air-conditioning air, comprising a display section that displays at least two pieces of information of selected ones of the plurality of outlets and/or selected ones of the plurality of flaps.

With this controller, pieces of information of all the outlets and/or the flaps are simultaneously listed. A user, by looking at this list, can grasp the current settings of all the outlets and flaps at once.

A second aspect of the present invention is the controller of the first aspect, further comprising: an operation section that accepts an operation entered to control the position of the plurality of flaps, wherein the display section simultaneously displays information indicative of the discharge directions of the air-conditioning air from selected ones of the plurality of outlets.

With this controller, the user can visually confirm on the display section the wind directions currently set for the outlets.

A third aspect of the present invention is the controller of the first aspect, adapted so that: in the indoor unit, different sign sections are respectively provided either in the vicinity of the plurality of outlets or on the plurality of flaps; and the display section is capable of displaying information corresponding to the sign sections.

With this controller, the flap in need of, for example, wind direction change can be individually identified only by looking at the sign sections formed in the vicinity of the plurality of outlets or on the plurality of flaps. Further, with the display on the display section corresponding to the sign sections, the plurality of outlets or the plurality of flaps are easily recognized.

A fourth aspect of the present invention is the controller of the third aspect, adapted so that the display section is capable of displaying information corresponding to the sign sections simultaneously with information indicative of the discharge directions of the air-conditioning air at the outlets indicated by the sign sections.

With the controller, usability can be improved, because a user looking at the display section can simultaneously grasp the outlets and the discharge directions currently set for the outlets.

A fifth aspect of the present invention is the controller of the second aspect, adapted so that the operation section enables the positions of the plurality of flaps to be individually changed so as to change the discharge direction of the air-conditioning air at the plurality of outlets.

With this controller, the positions of the flaps can be individually changed.

A sixth aspect of the present invention is the controller of the second aspect, adapted so that the operation section enables the positions of the plurality of flaps to be changed at once so as to change the discharge direction of the air-conditioning air at the plurality of outlets.

With this controller, the position of each flap can be changed at once without accompanying individual operations for the flaps.

A seventh aspect of the present invention is the controller of the sixth aspect, adapted so that the operation section enables the positions of the selected ones of the plurality of flaps to be changed at once so as to change the discharge direction of the air-conditioning air at the plurality of outlets.

With this controller, the positions of only the selected flaps can be changed at once.

An eighth aspect of the present invention is the controller of the first aspect, connected to an air conditioner via a wire.

Although the controller is a wired remote control, pieces of information of the outlets and the flaps are simultaneously displayed in a list as in the case of the wireless remote control.

A ninth aspect of the present invention is an air conditioner comprising the controller according to any one of the first to eighth aspects.

In this air conditioner, the same advantages obtained with the controller of any one of the first to eighth aspects can be obtained.

A tenth aspect of the present invention is the air conditioner of the ninth aspect, adapted so that, in the indoor unit, different sign sections are respectively provided either in the vicinity of the plurality of outlets or on the plurality of flaps.

In this air conditioner, the flap in need of, for example, wind direction change can easily be identified only by looking at the sign sections formed in the vicinity of the plurality of outlets or on the plurality of flaps.

An eleventh aspect of the present invention is the air conditioner of the tenth aspect, adapted so that the sign sections are three-dimensionally provided as raised portions or recessed portions.

In this air conditioner, a user can easily identify the sign sections, because the sign sections are three-dimensionally provided as raised portions or recessed portions.

A twelfth aspect of the present invention is the air conditioner of the tenth aspect, adapted so that, in the indoor unit, the sign sections are provided by being printed or by attaching stickers.

In the air conditioner, the sign sections can easily be formed by being printed or by attaching stickers.

A thirteenth aspect of the present invention is the air conditioner of any one of the tenth to twelfth aspects, adapted so that the sign sections are provided as characters, figures, or combinations of characters and figures.

In this air conditioner, a user can individually identify the outlets and the flaps more reliably, because the sign sections are provided as characters, figures, or combinations of characters and figures.

Advantage of the Invention

As described above, the present invention has the following effects.

With the first aspect, pieces of information of all the outlets and/or the flaps are simultaneously listed. A user, by looking at this list, can grasp the current settings of all the outlets and flaps at once.

Further, with the second aspect, the user can visually confirm on the display section the wind directions currently set for the outlets.

Further, with the third aspect, the flap in need of, for example, wind direction change can be individually identified only by looking at the sign sections formed in the vicinity of the plurality of outlets or on the plurality of flaps. Further, with the display on the display section corresponding to the sign sections, the plurality of outlets or the plurality of flaps are easily recognized.

Further, with the fourth aspect, usability can be improved, because a user looking at the display section can simultaneously grasp the outlets and the discharge directions currently set for the outlets.

Further, with the fifth aspect, the positions of the flaps can be individually changed.

Further, with the sixth aspect, the position of each flap can be changed at once without accompanying individual operations for the flaps.

Further, with the seventh aspect, the positions of only the selected flaps can be changed at once.

Further, with the eighth aspect, although the controller is a wired remote control, pieces of information of the outlets and the flaps are simultaneously displayed in a list as in the case of the wireless remote control.

Further, with the ninth aspect, the same advantages obtained with any one of the first to eighth aspects can be obtained.

Further, with the tenth aspect, the flap in need of, for example, wind direction change can easily be identified only by looking at the sign sections formed in the vicinity of the plurality of outlets or on the plurality of flaps.

Further, with the eleventh aspect, a user can easily identify the sign sections, because the sign sections are three-dimensionally provided as raised portions or recessed portions.

Further, with the twelfth aspect, the sign sections can easily be formed by being printed or by attaching stickers.

Further, with the thirteenth aspect, a user can individually identify the outlets and the flaps more reliably, because the sign sections are provided as characters, figures, or combinations of characters and figures.

BRIEF DESCRIPTION OF THE DRAWINGS

FIG. 10 is a diagram representing a screen displayed in a display section of the wired remote control.

FIG. 11 is a diagram representing a screen displayed in a display section of the wired remote control.

FIG. 12 is a diagram representing a screen displayed in a display section of the wired remote control.

FIG. 15 is a diagram representing a screen displayed in a display section of the wired remote control.

MODE FOR CARRYING OUT THE INVENTION

<First Embodiment>

The indoor unit and the air conditioner according to First Embodiment of the present invention are described below with reference to the accompanying drawings.

[Basic Configuration of Indoor Unit]

Figure 1:
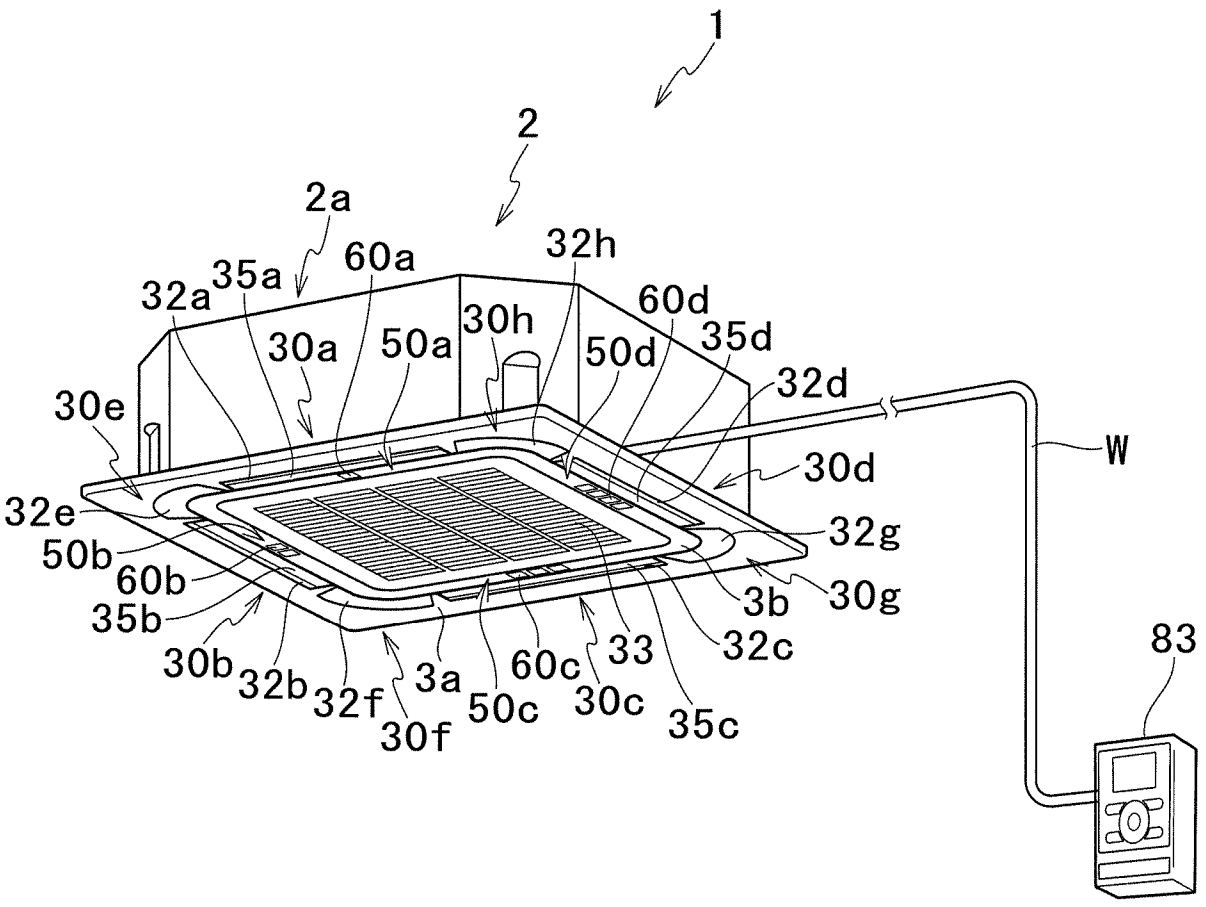
FIG. 1 is an external perspective view of the indoor unit according to First Embodiment of the present invention.
Figure 2:
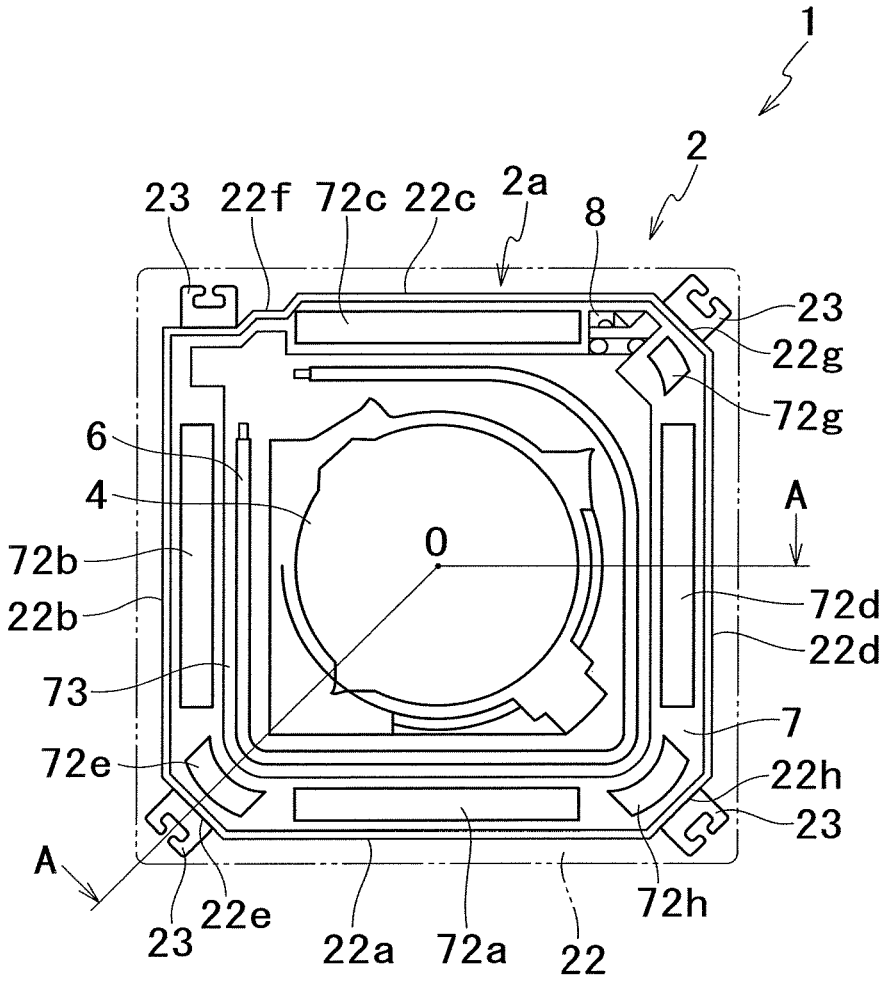
FIG. 2 is a schematic planar cross sectional view of the indoor unit.
Figure 3:
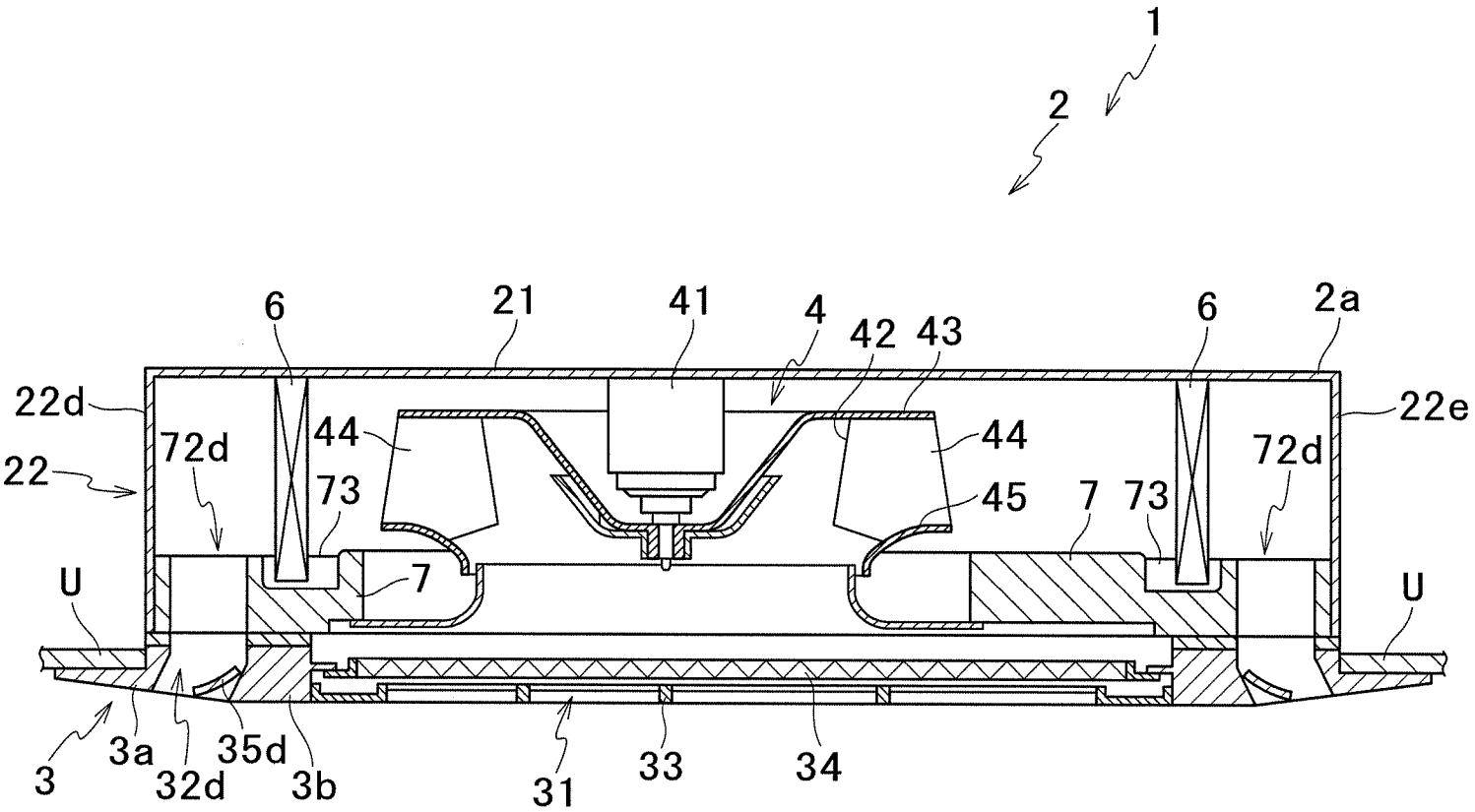
FIG. 3 is a cross sectional view taken at line A-O-A of FIG. 2.
Figure 4:
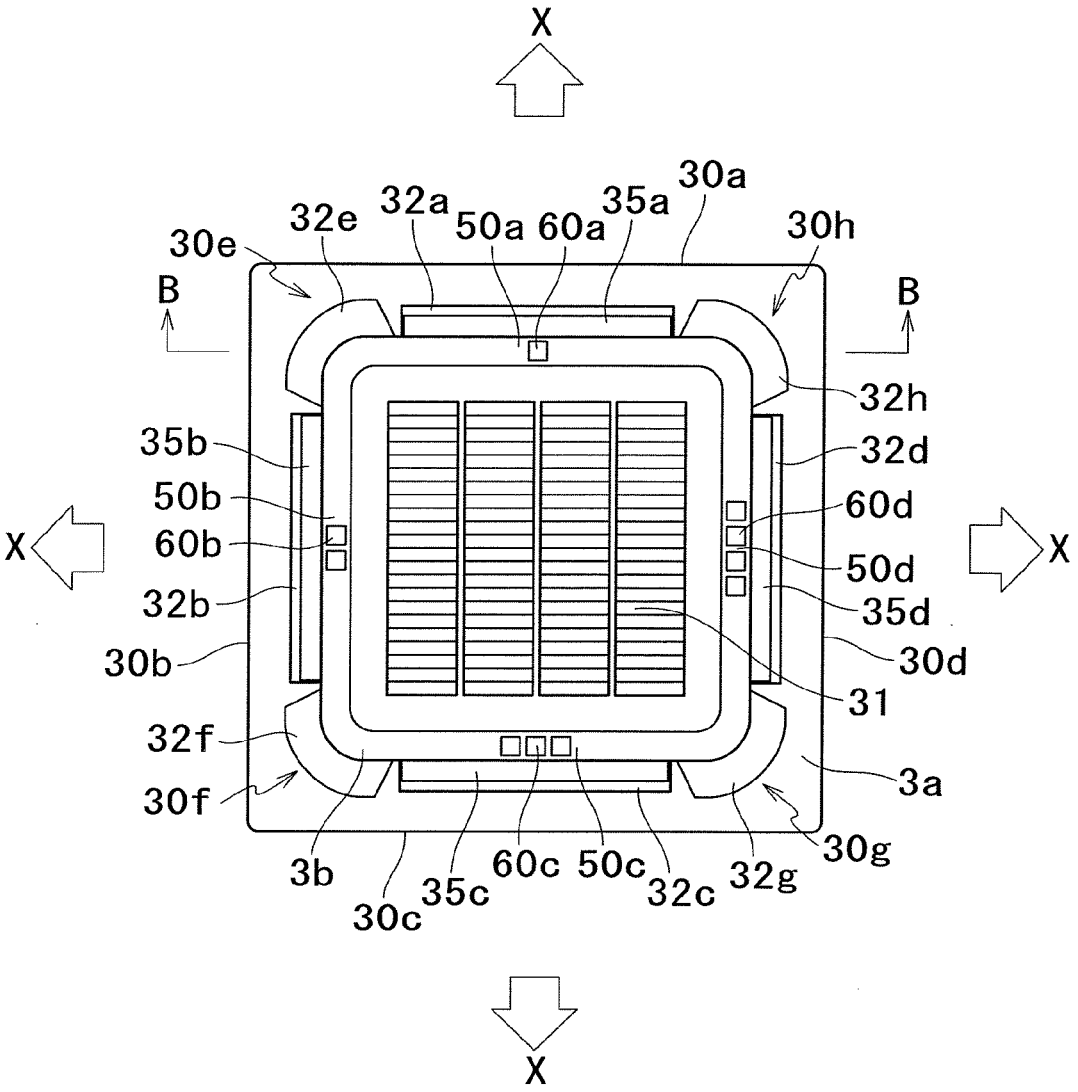
FIG. 4 is a plan view of a decorative panel of the indoor unit as viewed from an air-conditioned room.
Figure 5:
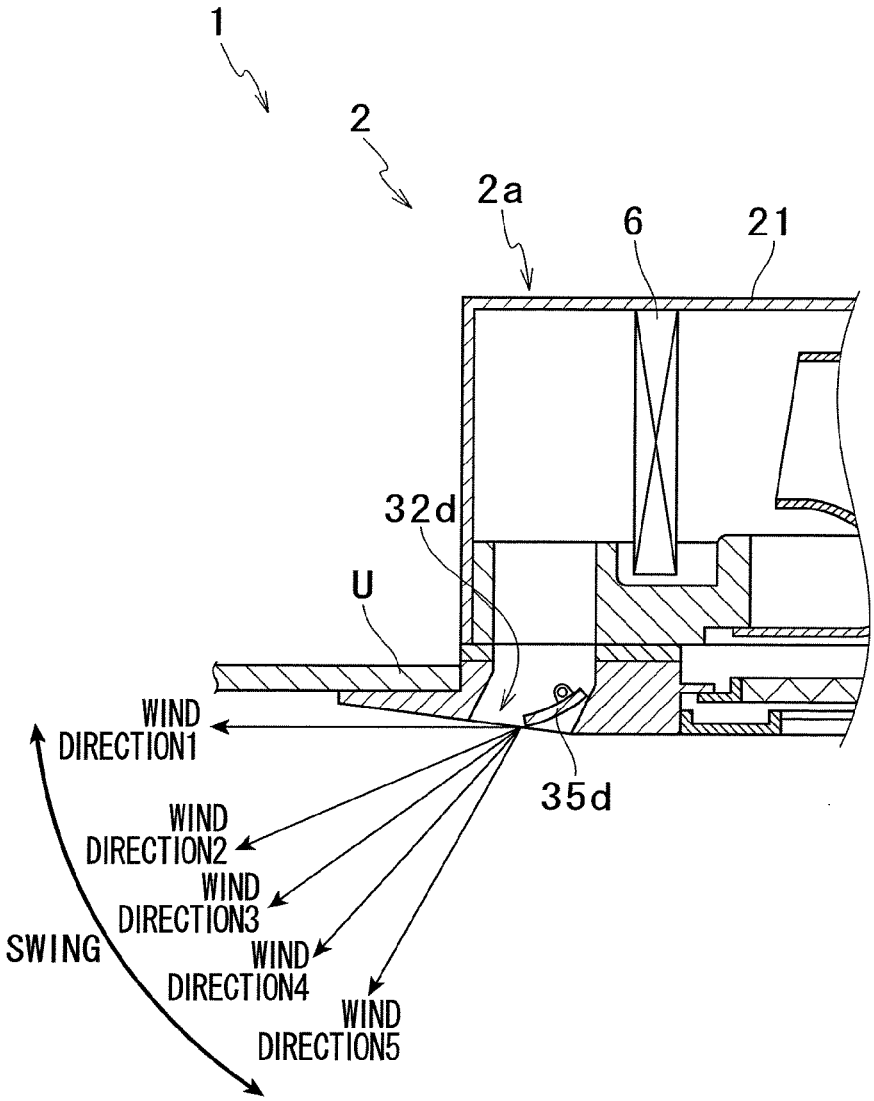
FIG. 5 is an enlarged view of FIG. 3, illustrating a channel portion corresponding to a main outlet.
Figure 6:
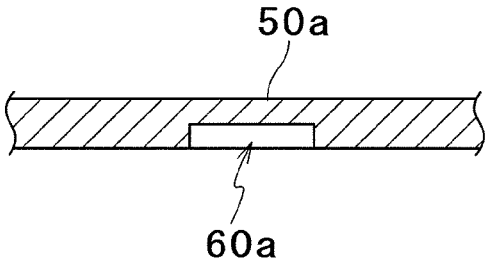
FIG. 6 is a cross sectional view taken at line B-B of FIG. 4.

FIG. 1 is an external perspective view of an indoor unit 1 according to First Embodiment of the present invention. FIG. 2 is a schematic planar cross sectional of the indoor unit 1. FIG. 3 is a cross sectional view taken at line A-O-A of FIG. 2. FIG. 4 is a plan view of a decorative panel of the indoor unit 1 as viewed from an air-conditioned room. FIG. 5 is an enlarged view of FIG. 3, illustrating a channel portion corresponding to a main outlet 32*d*. FIG. 6 is a cross sectional view taken at line B-B of FIG. 4.

As illustrated in FIG. 1, the indoor unit 1 is a ceiling embedded indoor unit, and includes a casing 2 housing various constituting units therein. The casing 2 is configured from a casing main body 2*a*, and a decorative panel 3 disposed under the casing main body 2*a*. The casing main body 2*a*, as illustrated in FIG. 3, is disposed by being inserted into the opening formed in ceiling U of an air-conditioned room. The decorative panel 3 is fitted to the opening of the ceiling U. The indoor unit 1 can be controlled by the operation of a wired remote control 83 connected via a communication cable W (wire) laid along the ceiling surface (not illustrated).

[Configuration of Casing Main Body]

As illustrated in FIGS. 2 and 3, the casing main body 2*a* is box-like in shape with a substantially octagonal open bottom of alternating longer sides and shorter sides as seen in a planar view, and includes a substantially octagonal top board 21 formed by the continuous and alternating longer sides and shorter sides, and side boards 22 extending downward from the peripheries of the top board 21. The side boards 22 include side boards 22*a* to 22*d* corresponding the longer sides of the top board 21, and side boards 22*e* to 22*h* corresponding to the shorter sides of the top board 21. For example, as illustrated in FIG. 2, the side board 22*a* and the side board 22*b* are disposed substantially orthogonal to each other via the side board 22*e*. The side boards 22*b* and 22*c*, the side boards 22*c* and 22*d*, and the side boards 22*d* and 22*a* are also disposed in a substantially orthogonal fashion.

The side board 22*e* is disposed at an about 135 degree angle with respect to the adjacent side boards 22*a* and 22*b*. The side boards 22*g* and 22*h* are also disposed at an about 135 degree angle with respect to the adjacent side boards, as with the side board 22*e*. Note that the side board 22*f* has a different shape from the other side boards, because the side board 22*f* is where a refrigerant pipe provided for the exchange of a refrigerant between a heat exchanger 6 and an outdoor unit (not illustrated) passes through. The side boards 22*e* to 22*h* are each provided with a fixing bracket 23 used to install the casing main body 2*a* in the ceiling space. In the casing main body 2*a*, the lengths of the longer and shorter sides of the top board 21 are set so that the shape including the fixing brackets 23 appears substantially rectangular as seen in a planar view.

[Configuration of Decorative Panel]

As illustrated in FIGS. 1 and 4, the decorative panel 3 is a substantially rectangular plate unit as seen in a planar view, and configured from mainly a panel main body 3*a* fixed to the bottom portions of the casing main body 2*a*. The panel main body 3*a* has alternately and continuously formed four panel side portions 30*a* to 30*d* (side portions) and four panel corner portions 30*e* to 30*h*. The panel side portions 30*a* to 30*d* correspond to the side boards 22*a* to 22*d*, respectively, of the casing main body 2*a*. The panel corner portions 30*e* to 30*h* correspond to the side boards 22*e* to 22*h*, respectively, of the casing main body 2*a*.

As illustrated in FIG. 1, the panel main body 3*a* includes an intake 31 formed substantially at the center to draw air from the air-conditioned room, and four main outlets 32*a* to 32*d*, respectively corresponding to the panel side portions 30*a* to 30*d*, through which the air inside the casing main body 2*a* discharges into the air-conditioned room. In the present embodiment, the intake 31 is a substantially square opening. The four main outlets 32*a* to 32*d* have substantially the same shape, and are disposed along the panel side portions 30*a* to 30*d*, respectively.

Further, as illustrated in FIGS. 1 and 4, the panel main body 3*a* includes auxiliary outlets 32*e* to 32*h*, corresponding in position to the panel corner portions 30*e* to 30*h*, respectively. Further, as illustrated in FIG. 1, a four-sided, flat annular, panel lower surface portion 3*b* is provided around the intake 31 on the lower surface of the panel main body 3*a* by being surrounded by the four main outlets 32*a* to 32*d*. As illustrated in FIG. 4, the panel lower surface portion 3*b* has rim portions 50*a* to 50*d* in the vicinity of the main outlets 32*a* to 32*d*, on the intake 31 side of the main outlets 32*a* to 32*d*.

As illustrated in FIG. 4, the intake 31 is disposed on the inner side of the main outlets 32*a* to 32*d*. The intake 31 includes an intake grill 33, and a filter 34 provided to remove dust in the air drawn through the intake 31. Further, as illustrated in FIG. 4, the main outlets 32*a* to 32*d* are provided with flaps 35*a* to 35*d*, respectively, that are swingable about an axis along the longitudinal direction. The flaps 35*a* to 35*d* are long, narrow substantially rectangular blade members of substantially the same shape extending along the longitudinal direction of their respective main outlets 32*a* to 32*d*. The flaps 35*a* to 35*d* are swingable about an axis along the longitudinal direction of the main outlets 32*a* to 32*d* by being rotatably supported on the decorative panel 3.

[Configuration of Sign Sections]

As illustrated in FIG. 4, sign sections 60*a* to 60*d* for individually recognizing the main outlets 32*a* to 32*d* or the flaps 35*a* to 35*d* are formed on the rim portions 50*a* to 50*d* of the panel lower surface portion 3*b*. The sign sections 60*a* to 60*d* are formed as figures "□", "□□", "□□□", and "□□□□". The sign sections 60*a* to 60*d* are formed on the intake 31 side of the main outlets 32*a* to 32*d*. The figures "□" to "□□□□" correspond to numbers "1" to "4", respectively, which, in FIG. 4, are arranged in ascending order in the counterclockwise direction. The figures "□" to "□□□□" are disposed in positions corresponding to the main outlets 32*a* to 32*d*, respectively. As illustrated in FIG. 6, the sign sections 60*a* to 60*d* are three-dimensionally "□□□□" provided as recessed portions in the rim portions 50*a* to 50*d*. Note that the areas surrounding the sign sections 60*a* to 60*d* are matte finished (surface texturing), whereas the sign sections are more glossy (gloss portions) relative to the surroundings.

The flaps 35*a* to 35*d* can be set to the swing state that involves continuous driving by flap motors 40*a* to 40*d* (see FIG. 7), or the stationary state in which the discharge direction of air-conditioning air is fixed. In the swing state setting, the flaps 35*a* to 35*d* continuously swing to change the discharge direction of the air-conditioning air. On the other hand, in the stationary state setting, the flaps 35*a* to 35*d* assume the predetermined wind direction position and fix the discharge direction of the air-conditioning air in a certain direction. As illustrated in FIG. 4, the flaps 35*a* to 35*d* can swing to individually change the wind directions of the air flow X discharged into the air-conditioned room through the main outlets 32*a* to 32*d*.

For example, as illustrated in FIG. 5, the wind direction of the air flow X discharged into the air-conditioned room through the main outlet 32*d* can be varied by the flap 35*d* upwardly and downwardly with respect to the lower surface of the ceiling U. As illustrated in FIG. 5, the wind direction of the air flow X can have six settings: "wind direction 1" to "wind direction 5", and "swing" in which the flaps swing over the range of "wind direction 1" to "wind direction 5". The wind directions are set so that the wind is sloped more downwardly with increasing numbers from "wind direction 1" to "wind direction 5". Note that the wind directions of the air flow X discharged into the air-conditioned room through the other main outlets 32*a* to 32*c* are also variable upwardly and downwardly with respect to the lower surface of the ceiling U, and can have any of the six settings, though not described.

As illustrated in FIG. 3, inside the casing main body 2*a* are provided mainly an air blower 4 that blows air towards the periphery after drawing the air inside the air-conditioned room into the casing main body 2*a* through the intake 31 of the decorative panel 3, and a heat exchanger 6 disposed around the periphery of the air blower 4. In the present embodiment, the air blower 4 is a turbo fan, and includes a fan motor 41 provided at the center of the top board 21 of the casing main body 2*a*, and an impeller 42 joined to and rotated by the fan motor 41.

The impeller 42 includes a disc-shaped end plate 43 joined to the fan motor 41, a plurality of blades 44 provided at the periphery on the lower surface of the end plate 43, and a disc-shaped end ring 45 provided on the lower side of the blades 44 and having an opening at the center. By the rotation of the blades 44, the air blower 4 can draw air into the impeller 42 through the opening of the end ring 45, and can discharge the intake air in the impeller 42 towards the periphery of the impeller 42.

In the present embodiment, the heat exchanger 6 is a cross-fin-tube heat exchanger panel formed by being bent around the periphery of the air blower 4, and is connected via a refrigerant pipe to an outdoor unit (not illustrated) installed, for example, outside. The heat exchanger 6 is adapted to serve as an evaporator for the passing refrigerant in cooling mode, and as a condenser for the passing refrigerant in heating mode. In this way, the heat exchanger 6 can cool air in cooling mode and heat air in heating mode by the heat exchange of the air drawn into the casing main body 2*a* through the intake 31 by the air blower 4.

A drain pan 7 for receiving drained water generated by the condensation of the air moisture in the heat exchanger 6 is disposed on the lower side of the heat exchanger 6. The drain pan 7 is attached to the lower portion of the casing main body 2*a*. As illustrated in FIGS. 2 and 3, the drain pan 7 includes four main discharge holes 72*a* to 72*d* in communication with the main outlets 32*a* to 32*d* of the decorative panel 3, and a drained water receptacle groove 73 formed on the lower side of the heat exchanger 6 to receive the drained water. The main discharge holes 72*a* to 72*d* are shorter along the longitudinal direction of their respective main outlets 32*a* to 32*d*. The length of the main discharge hole 72*c* is particularly shorter along the longitudinal direction than the lengths of the other main discharge holes 72*a*, 72*b*, and 72*d*, because the main discharge hole 72*c* is interposed between a drain pump 8 disposed on the side board 22*g* side and used to drain the drained water accumulated in the drained water receptacle groove 73, and the portion where the refrigerant pipe running on the side board 22*h* side passes through.

[Configuration of Control Unit]

Figure 7:
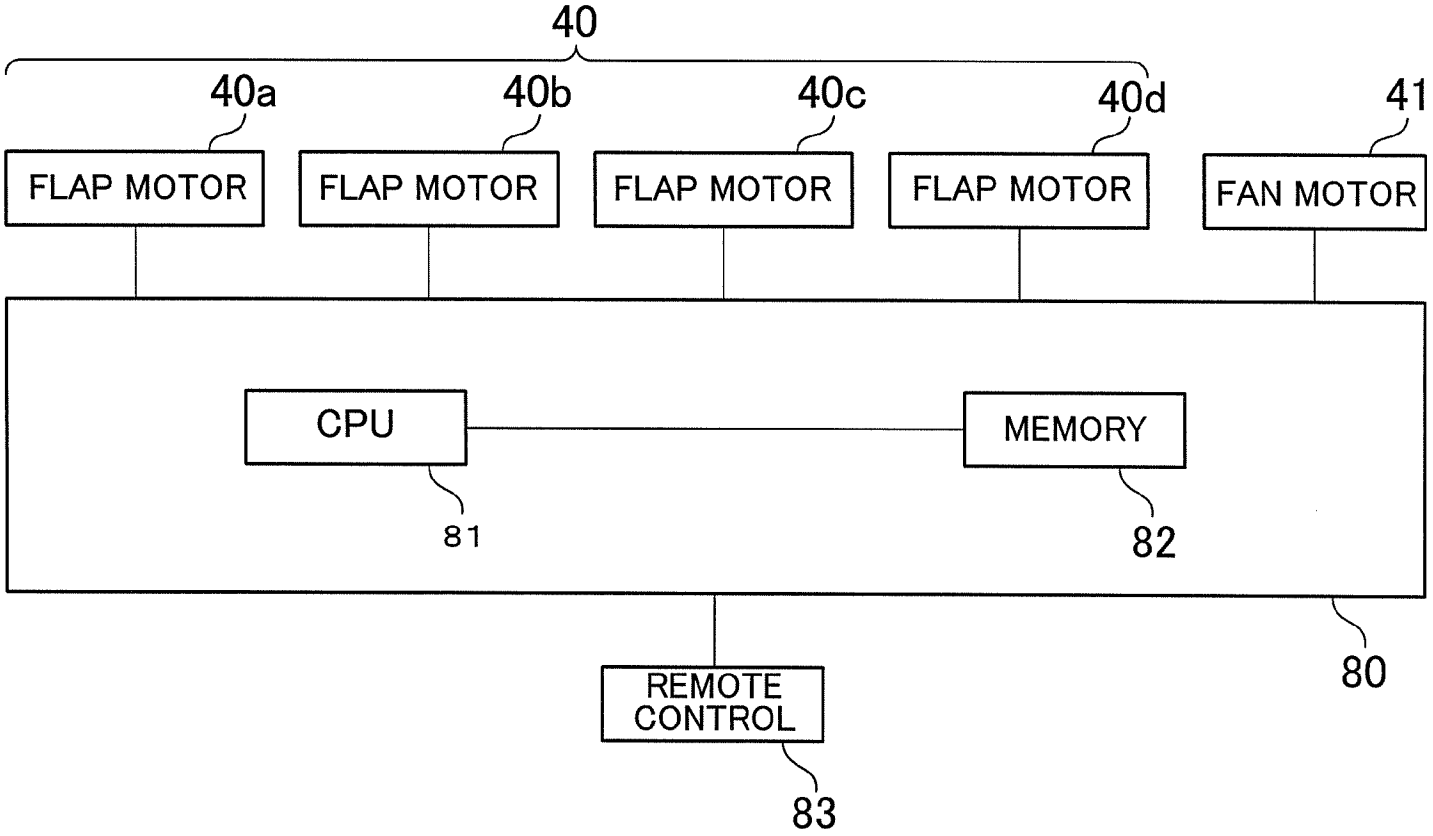
FIG. 7 is a schematic control block diagram of the indoor unit.

As illustrated in FIG. 7, the indoor unit 1 includes a control unit 80 that controls parameters such as the rotation speed of the air blower 4, and the wind directions of the flaps 35*a* to 35*d*. The control unit 80 mainly includes a microcomputer equipped with a CPU 81 and memory 82. The control unit 80 receives control signals via the wired remote control 83, and, upon receiving the signals, the CPU 81 executes the control program stored in the memory 82 to actuate the fan motor 41 of the air blower 4, and the flap motors 40*a* to 40*d* that drive the flaps 35*a* to 35*d*. In this way, the control of the rotation speed of the air blower 4 and the wind directions of the flaps 35*a* to 35*d* is enabled.

[Configuration of Wired Remote Control]

Figure 8:
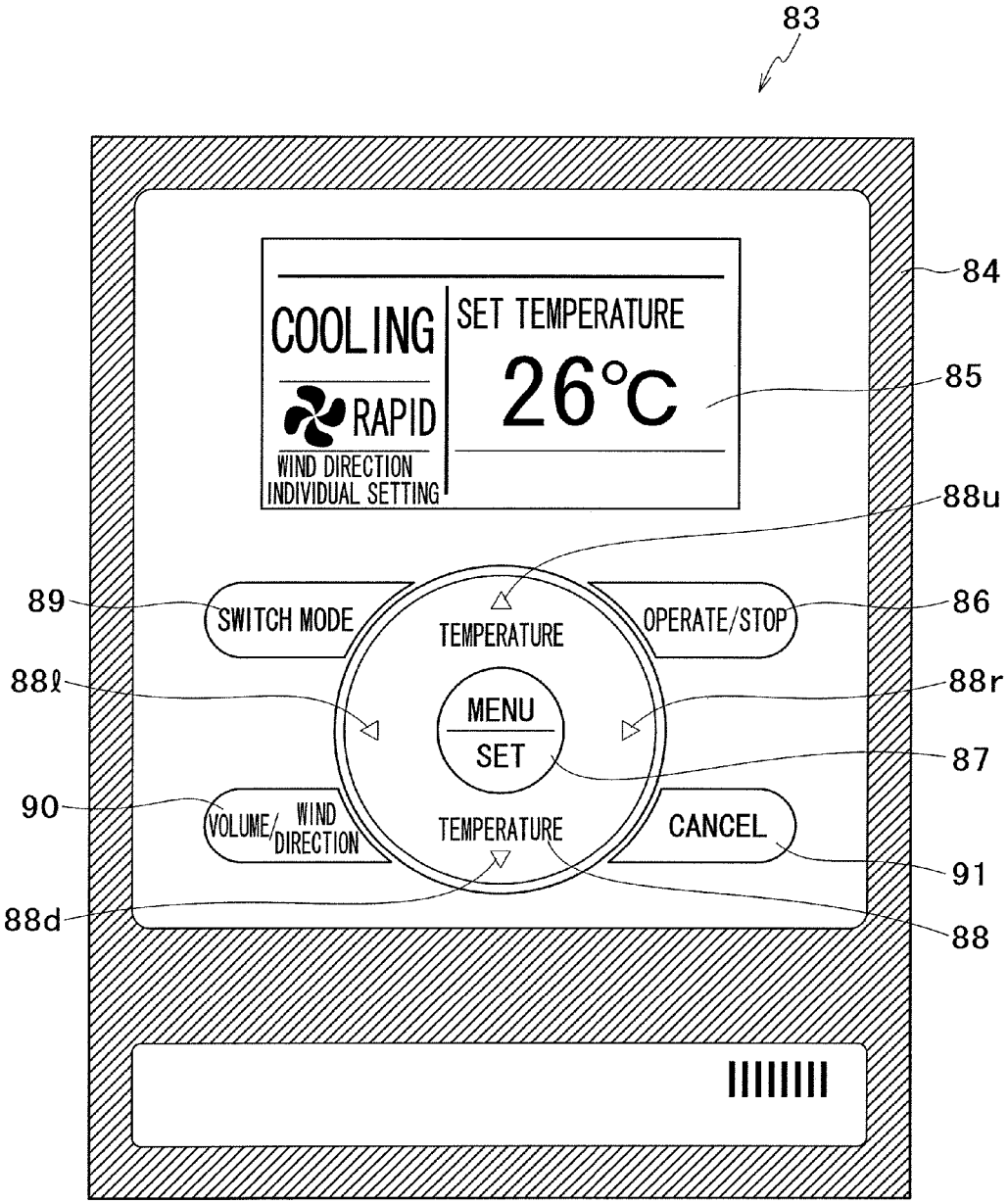
FIG. 8 is a front view of a wired remote control according to the embodiment of the invention.
Figure 9:
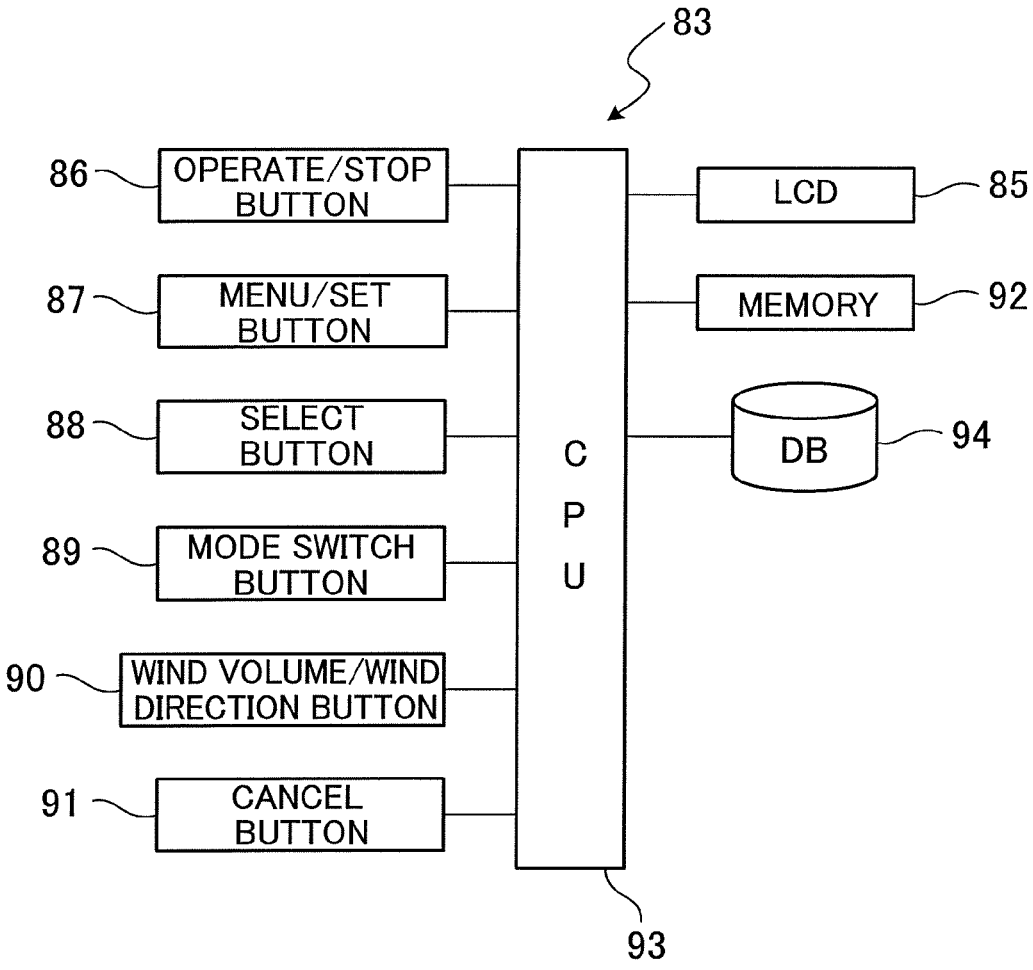
FIG. 9 is a schematic control block diagram of the wired remote control.

FIG. 8 is a front view of the wired remote control 83 according to the present embodiment. FIG. 9 is a schematic control block diagram of the wired remote control 83. FIG. 10 represents various screens displayed in a display section 85 of the wired remote control 83.

As illustrated in FIG. 8, the wired remote control 83 includes a remote control casing 84, the display section 85, various operation buttons 86 to 91, memory 92 storing various data concerning the operation of the indoor unit 1, a CPU 93, and database 94. The remote control casing 84 is substantially rectangular in shape, and houses the CPU 93 and other components therein. The display section 85 is capable of displaying various settings screens, in addition to a basic screen and various menu screens.

The operation buttons 86 to 91 (operation sections) are provided on the front face of the remote control casing 84. The operate/stop button 86 is a button that a user uses to enter an instruction for starting or stopping the operation of the indoor unit 1. The menu/set button 87 is a circular button surrounded by a doughnut-shaped select button 88, and is used by a user when changing the various settings of the indoor unit 1. Pressing the menu/set button 87 enables the display section 85 to display a main menu screen D1. The menu/set button 87 also functions to set each setting item selected in the main menu screen D1.

The select button 88 has an up selector 88*u*, a down selector 88*d*, a left selector 88*l*, and a right selector 88*r*, each marked with the symbol Δ indicative of the direction (up, down, left, or right). The four selectors 88*u* to 88*r* are integral in appearance, and represent the allocated regions up, down, left, and right of the select button 88. Pressing the selector 88*u* to 88*r* moves the cursor, enabling a user to select, for example, a setting item or a setting value for the indoor unit 1.

The mode switch button 89 is a button used to switch the operation mode of the indoor unit 1 between heating mode and cooling mode. The wind volume/wind direction button 90 is a button that a user uses to change the total wind volume/total air direction of the outlets 32*a* to 32*d*. The CPU 93 runs a program to control the operation of the indoor unit 1. The database 94 stores various kinds of information, including the layout data for forming a screen displayed in the display section 85. Examples of layout data include basic layout data for forming the basic screen D0 shown in FIG. 10, main menu layout data for forming the main menu screen D1 shown in FIG. 11, and detailed settings layout data for the total wind volume/total wind direction adjust screen D2 shown in FIGS. 12 and 13, the wind direction individual setting screen D3 shown in FIG. 14, and the wind direction settings check screen D4 shown in FIG. 15.

[Configurations of Screens Displayed in Display Section 85]

FIGS. 10 to 15 represent various screens displayed in the display section 85 of the wired remote control 83.

[Basic Screen Configuration]

FIG. 10(*a*) and (*b*) represents examples of the basic screen D0 displayed in the display section 85. As shown in FIG. 10, the basic screen D0 is divided into a display region 100 that indicates the current temperature setting, a display region 101 that indicates the current operation mode setting, a display region 102 that indicates the current wind volume state setting, and a display region 103 that indicates whether the wind directions are individually set for the main outlets 32*a* to 32*d*.

As shown in FIG. 10(*a*), the display region 100 displays the character "26°". In FIG. 10(*b*), the display region 100 displays the character "26° C." as the current temperature setting, the display region 101 the character "Cooling" as the current operation mode setting, and the display region 102 the character "Auto" as the current wind volume state setting.

The display region 103 displays the character "Individual setting" when the wind direction is individually set for at least one of the main outlets 32*a* to 32*d*, and does not display any text when the wind direction is not individually set for any of the main outlets 32*a* to 32*d*. In FIG. 10(*a*) and (*b*), the wind direction is individually set for any of the outlets 32*a* to 32*d*, and as such the display region 103 displays the character "Individual setting". The display region 103 may display the character "No individual setting" when the wind direction is not individually set for any of the outlets 32*a* to 32*d*. Pressing the menu/set button 87 in the basic screen D0 changes the display to the main menu screen D1 shown in FIG. 11. Pressing the wind volume/wind direction button 90 in the basic screen effects the interrupt processing, and changes the display to the total wind volume adjust screen D2 shown in FIG. 12.

[Configuration of Main Menu Screen]

FIG. 11(*a*) and (*b*) represents examples of the main menu screen D1 displayed in the display section 85. As shown in FIG. 11, the main menu screen D1 has six setting items for the indoor unit 1. Specifically, menu titles are listed that correspond to "Service contact information/model name", "Wind direction individually setting", "Check wind direction setting", "Timer setting", "Energy saving setting", and "Useful functions".

FIG. 11 (*a*) represents the initial screen that appears upon switching to the main menu screen D1. In the initial screen, the cursor is on the menu title corresponding to the setting item "Service contact information/model name" from the different setting items. Pressing the down selector 88*d* in this state moves the cursor down in the display section 85 in turn, allowing the user to select a setting item by placing the cursor on one of the menu titles "Wind direction individually setting" to "Useful functions".

Figure 14:
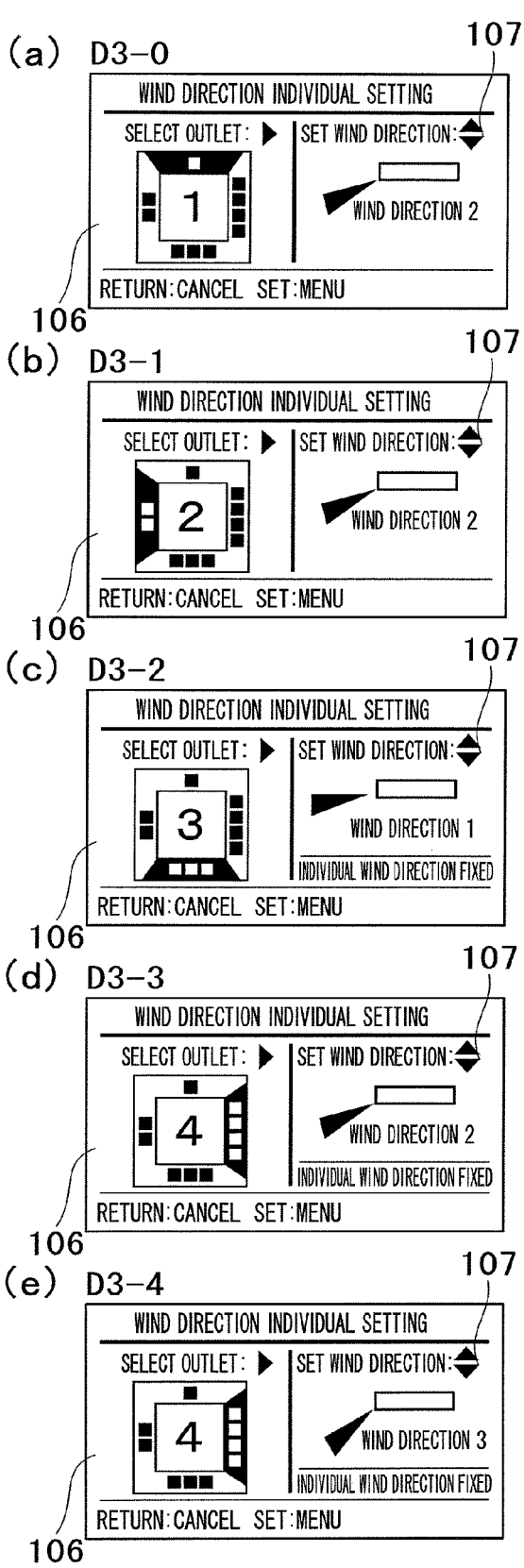
FIG. 14 is a diagram representing a screen displayed in a display section of the wired remote control.

For example, as shown in FIG. 11(*b*), pressing the menu/set button 87 while the setting item "Wind direction individually setting" is selected, the main menu screen D1 switches to the wind direction individual setting screen D3 shown in FIG. 14. The user can then individually set the wind direction for any of the main outlets 32*a* to 32*d*, based on the wind direction individual setting screen D3. Further, for example, pressing the menu/set button 87 while the setting item "Check wind direction setting" is selected, the main menu screen D1 switches to the wind direction settings check screen D4 shown in FIG. 15. On the wind direction settings check screen D4, the user can then visually confirm all the wind directions currently set for the main outlets 32*a* to 32*d*.

[Configuration of Total Wind Volume/Total Wind Direction Adjust Screen]

Figure 13:
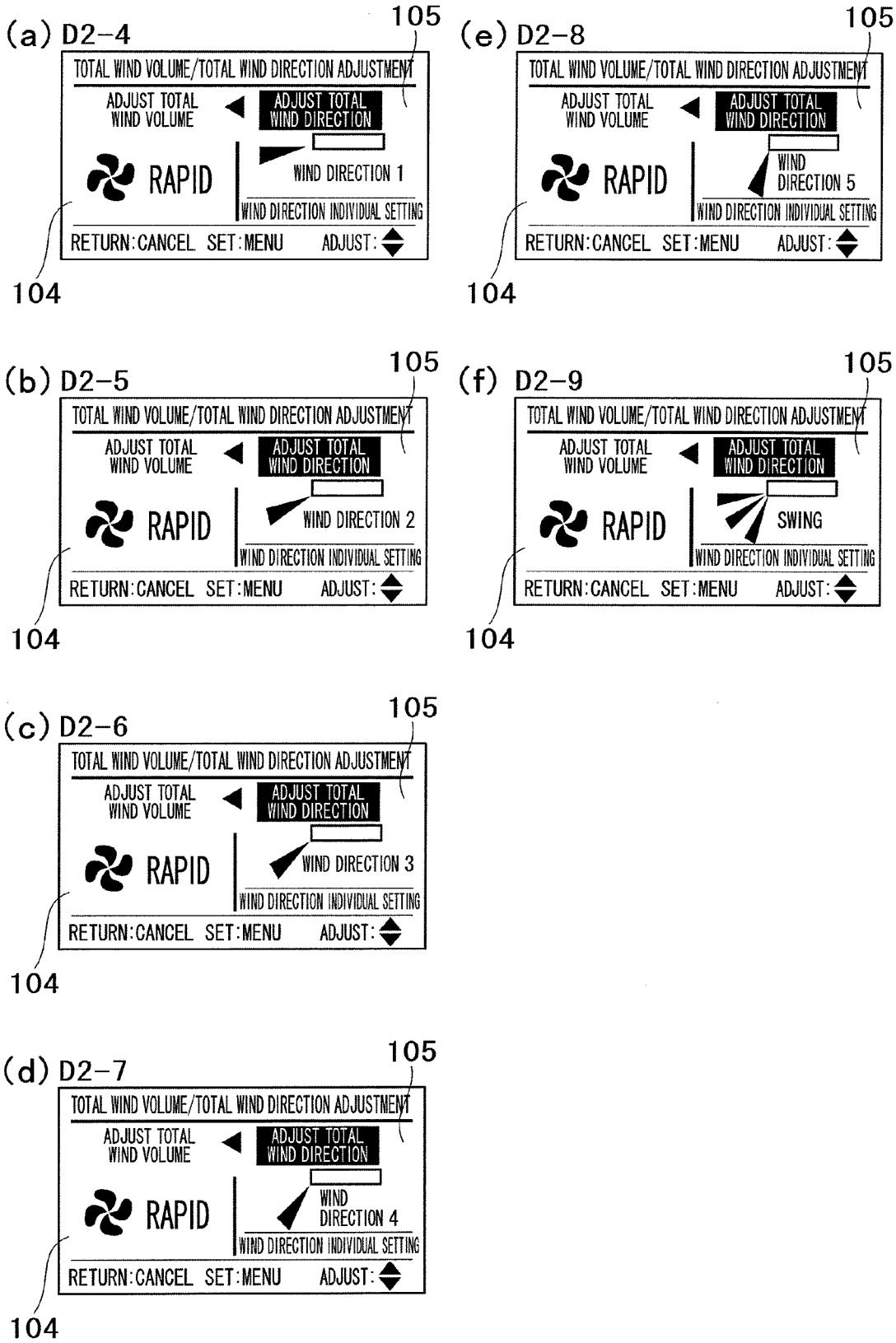
FIG. 13 is a diagram representing a screen displayed in a display section of the wired remote control.

FIG. 12(*a*) to (*e*) and FIG. 13(*a*) to (*h*) represent examples of the total wind volume/total wind direction adjust screen D2 displayed in the display section 85. As shown in FIGS. 12 and 13, the total wind volume/total wind direction adjust screen D2 is divided into display regions 104 and 105. Menu titles corresponding to the two setting items "Adjust total wind volume" and "Adjust total wind direction" are displayed in the upper part of each display region.

<Total Wind Volume Adjustment Operation>

FIG. 12(*a*) represents the initial screen D2-0 of the total wind volume/total wind direction adjust screen D2. In the initial screen, the cursor is on the menu title corresponding to the setting item "Adjust total wind volume". The display region 104 in the initial screen displays the character "Rapid", indicating that the total wind volume is currently "Rapid" for all of the main outlets 32*a* to 32*d*. The total wind volume of the main outlets 32*a* to 32*d* can be set to "Strong" (FIG. 12(*b*)), "Weak" (FIG. 12(*c*)), or "Auto" (FIG. 12(*d*)).

Pressing the cancel button 91 in the initial screen D2-0 shown in FIG. 12(*a*), switches the display to the basic screen D0 shown in FIG. 10. On the other hand, pressing the down selector 88*d* in the initial screen D2-0 switches the display to the settings screen D2-1 (FIG. 12(*b*)), the settings screen D2-2 (FIG. 12(*c*)), and the settings screen D2-3 (FIG. 12(*d*)) in turn. Pressing the menu/set button 87 in each display state changes the display in the display region 104 from "Strong" to "Weak", and to "Auto", allowing the user to set the total wind volume for the main outlets 32*a* to 32*d* at once. The display returns to the previous screen at the pressing of the up selector 88*u*.

<Total Wind Direction Adjustment Operation>

Pressing the right selector 88*r* in the state shown in FIG. 12(*a*), moves the cursor to the menu title corresponding to the setting item "Adjust total wind direction", and the initial screen D2-0 shown in FIG. 12(*a*) switches to the initial screen D2-4 for total wind direction adjustment shown in FIG. 13(*a*). Note that, in this example, the text "Wind direction individual setting" displayed in the lower part of the display region 105 in the initial screen means that the wind direction has been individually set to "Wind direction 1" for the main outlet 32*c*, and the total wind direction for the remaining main outlets 32*a*, 32*b*, and 32*d* other than the main outlet 32*c* is set at once, as follows. As an example, the main outlets 32*a*, 32*b*, and 32*d* other than the main outlet 32*c* may be selected by individually setting "Wind direction 1" for the main outlet 32*c* in advance, and the total wind direction may be set at once only for the wind direction positions of the flaps 35*a*, 35*b*, and 35*d* of the main outlets 32*a*, 32*b*, and 32*d* so selected. The text "Wind direction 1" displayed at the center of the display region 105 means that the total wind direction of the main outlets 32*a*, 32*b*, 32*d* is currently set to "Wind direction 1" altogether. The total wind direction of the main outlets 32*a*, 32*b*, and 32*d* may be set to any of "Wind direction 2" (FIG. 13(*b*)), "Wind direction 3" (FIG. 13(*c*)), "Wind direction 4" (FIG. 13(*d*)), "Wind direction 5" (FIG. 13(*e*)), and "Swing" (FIG. 13(*f*)).

Pressing the down selector 88*d* in the initial screen shown in FIG. 13(*a*), switches the display to the settings screen D2-5 (FIG. 13(*b*)), the settings screen D2-6 (FIG. 13(*c*)), the settings screen D2-7 (FIG. 13(*d*)), the settings screen D2-8 (FIG. 13(*e*)), and the settings screen D2-9 (FIG. 13(*f*)) in turn, changing the display of the display region 105 from "Wind direction 1" to "Wind direction 5", and to "Swing" in turn. Pressing the menu/set button 87 in each display state enables the total wind direction of the main outlets 32*a*, 32*b*, and 32*d* to be set at once. The display returns to the previous screen at the pressing of the up selector 88*u*.

In the screens shown in FIGS. 12 and 13, the character "Wind direction individual setting" is displayed to indicate that the wind direction is individually set for any of the main outlets. However, the display may indicate which of the main outlets has an individual wind direction setting. Specifically, in the presently described example, the display may indicate that the wind direction has been individually set for the main outlet 32*c*. Further, in the screens shown in FIGS. 12 and 13, the display may indicate which outlet is subject to the "Total wind direction setting". Specifically, in this example, the display may indicate that the main outlets 32*a*, 32*b*, and 32*d* are the subject of the "Total wind direction setting".

[Configuration of Wind Direction Individual Setting Screen]

FIG. 14(*a*) to (*g*) represents examples of the wind direction individual setting screen D3 displayed in the display section 85. As shown in FIG. 14, the wind direction individual setting screen D3 is divided into display regions 106 and 107. The display region 106 schematically displays the indoor unit 1 as viewed from the room, and symbols "□" to "□□□□" representing the sign sections 60*a* to 60*d* of the rim portions 50*a* to 50*d* are displayed in the diagram. The display region 107 displays the state of the wind direction currently set for the main outlets 32*a* to 32*d*.

FIG. 14(*a*) represents the initial screen D3-0 for wind direction individual setting. In the initial screen D3-0, the schematic view displayed in the display region 106 includes an inverted display, indicating that the main outlet 32*a* corresponding to symbol "□" has been selected. Further, in the initial screen D3-0, the number "1" displayed at the central part of the display region 106 corresponds to the main outlet 32*a*, and indicates that the main outlet 32*a* has been selected. The inverted display and the number thus provide visual information for a user to confirm that the outlet 32*a* is available for the individual setting of wind direction. Further, as shown in FIG. 14(*a*), the character "wind direction 2" is displayed at the center of the display region 107 in the initial screen D3-0, indicating that the main outlet 32*a* has been set to "wind direction 2".

<Wind Direction Individual Setting Operation>

The wind direction of the main outlet 32*a* can be selected from "wind direction 1" to "wind direction 5" and "Swing" by operating the up selector 88*u* or the down selector 88*d* in the state shown in FIG. 14(*a*). Pressing the menu/set button 87 while any of the wind directions is selected sets the main outlet 32*a* to the selected wind direction. On the other hand, pressing the cancel button 91 in the state shown in FIG. 14(*a*), switches the initial screen D3-0 to the main menu screen D1 shown in FIG. 11. Pressing the right selector 88*r* in the state shown in FIG. 14(*a*), switches the initial screen D3-0 to the settings screen D3-1 (FIG. 14(*b*)), the settings screen D3-2 (FIG. 14(*c*)), and the settings screen D3-3 (FIG. 14(*d*)) in turn, allowing the user to set any of "wind direction 1" to "wind direction 5" and "Swing" for the main outlets 32*b* to 32*d*.

<Wind Direction Individual Setting Operation for Main Outlet 32*d*>

As an example, the following describes how the "wind direction 2" set for the main outlet 32*d* as in FIG. 14(*d*) is changed to "wind direction 3". Pressing the down selector 88*d* in the settings screen D3-3 of FIG. 14(*d*) switches the display to the settings screen D3-4 shown in FIG. 14(*e*), and the display at the central part of the display region 107 switches to "wind direction 3". Pressing the menu/set button 87 while "wind direction 3" is displayed enables the wind direction of the main outlet 32*d* to be individually set to "wind direction 3".

[Configuration of Wind Direction Settings Check Screen]

FIG. 15(*a*) and (*b*) represents examples of the wind direction settings check screen D4 displayed in the display section 85. As shown in FIG. 15, the wind direction settings check screen D4 lists menu titles corresponding to three check items: "Outlet", "Wind direction", and "Individual setting", from left to right. As shown in (a) and (b) in FIG. 15, the column under the check item "Outlet" displays symbols "1■" to "4■■■■" for individually identifying the outlets 32*a* to 32*d*. The symbols "1■" to "4■■■■" correspond to the symbols "□" to "□□□□" (see FIG. 3) for individually identifying the main outlets 32*a* to 32*d*. Further, as shown in FIG. 15(*a*) and (*b*), the column under the check item "Wind direction" displays the wind directions of the main outlets 32*a* to 32*d*, simultaneously with the symbols "1■" to "4■■■■". Further, as shown in FIG. 15(*a*) and (*b*), the column under the check item "Individual setting" indicates whether the wind direction has been individually set for the main outlets 32*a* to 32*d*, and "o" is displayed in the cells corresponding to the individually set main outlets.

Specifically in FIG. 15(*a*), the main outlets 32*a*, 32*b*, and 32*d* have the total wind direction setting "wind direction 2", and only the wind direction of the main outlet 32*c* has the individual setting "wind direction 1". In the column under the check item "Individual setting", the symbol "o" is displayed in the cell corresponding to the main outlet 32*c*. In FIG. 15(*b*), the main outlets 32*a* and 32*b* have the total wind direction setting "wind direction 2", and the wind directions of the main outlets and 32*c* and 32*d* have the individual settings "wind direction 1" and "wind direction 3", respectively. Thus, the symbol "o" is displayed in the cells corresponding to the main outlets 32*c* and 32*d* under the check item "Individual setting". In the present embodiment, pressing the right selector 88*r* in the wind direction settings check screen of FIG. 15(*a*) and (*b*), switches the display to the initial screen D3-0 for wind direction individual setting shown in FIG. 14, enabling a user to individually set the wind direction for any of the main outlets. Note that the individual wing direction setting for any of the main outlets may be enabled while the wind direction settings check screen is displayed.

[Wind Volume/Wind Direction Adjustment Operation]

The wind volume/wind direction adjustment operation of the present embodiment is described below with reference to FIGS. 16 and 17.

Figure 16:
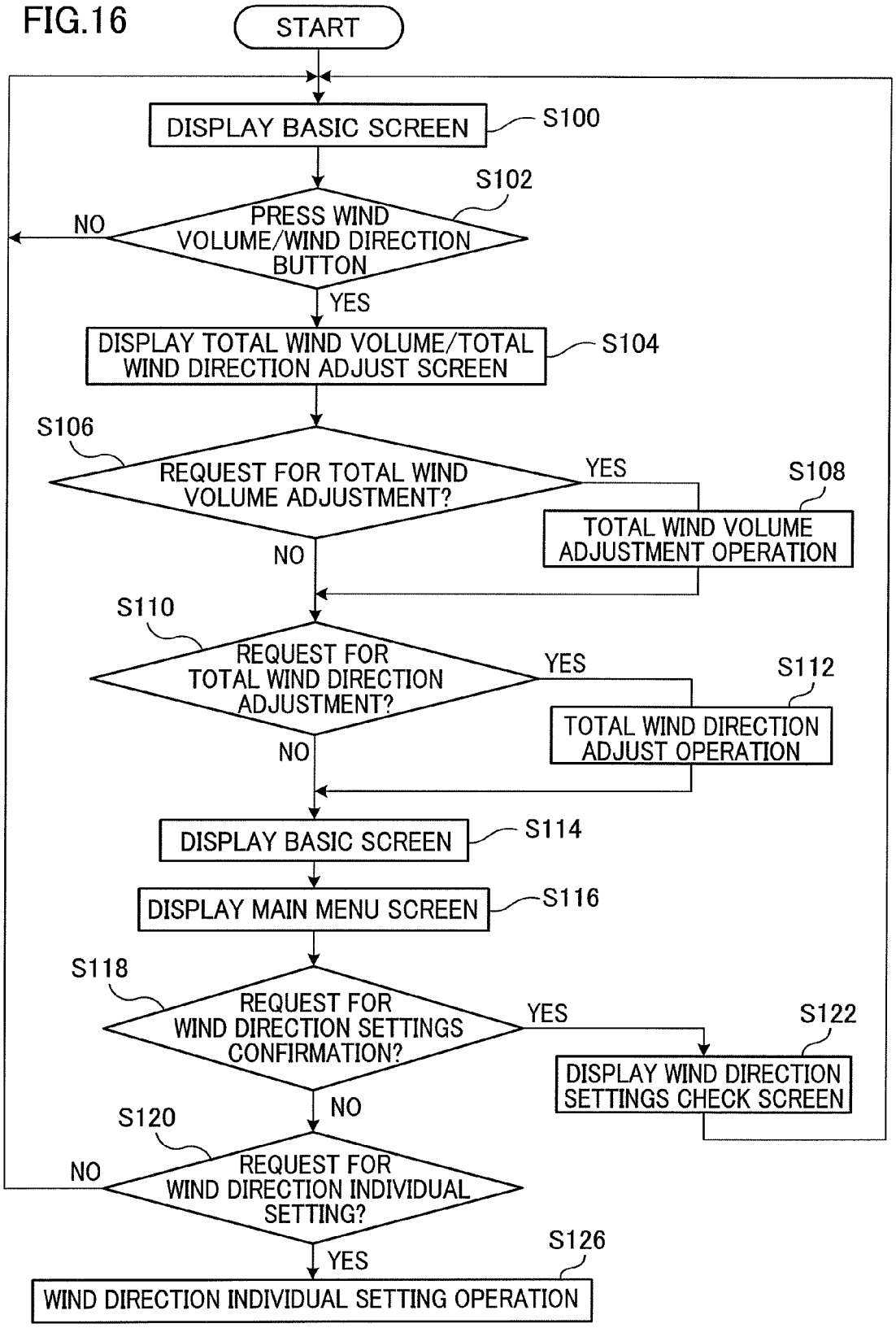
FIG. 16 is a flowchart representing the wind volume/wind direction adjustment operation of the embodiment of the invention.

FIG. 16 is a flowchart representing the wind volume/wind direction adjustment operation of the present embodiment. It should be noted that the "wind volume/wind direction adjustment operation" in the flowchart includes the "total wind volume adjustment operation", "total wind direction adjustment operation", "wind direction individual setting operation", and "wind direction settings check operation", as will be described later.

First, in step S100 in FIG. 16, the display section 85 displays the basic screen D0 (see FIG. 10(*a*)).

Then, it is determined in step S102 whether the wind volume/wind direction button 90 has been pressed. If it is determined that the wind volume/wind direction button 90 has been pressed, the sequence goes to step S104. On the other hand, the sequence goes to step S100 if it is determined that the wind volume/wind direction button 90 has not been pressed.

In the next step S104, the display section 85 displays the total wind volume/total wind direction adjust screen D2 (see FIG. 12(*a*) to (*d*)) for the group setting of the total wind volume for the main outlets 32*a* to 32*d*.

In the next step S106, it is determined whether a request for changing the currently set wind volume for the main outlets 32*a* to 32*d* to other wind volume has been entered. If a request for changing to other wind volume has been entered, the sequence goes to step 108, and the total wind volume adjustment operation is performed. On the other hand, the sequence goes to step S110 if a request for wind volume change has not been entered.

It is determined in step S110 whether a request for changing the currently set wind direction for the main outlets 32*a*, 32*b*, and 32*d* to other wind direction has been entered. If a request for changing to other wind direction has been entered, the sequence goes to step 112, and the total wind direction adjustment operation is performed. On the other hand, the sequence goes to step S110 if a request for wind volume change has not been entered.

In step S114, the display section 85 displays the basic screen D0.

In the next step S116, the display section 85 displays the main menu screen D1.

It is determined in the next step S118 whether a request for confirming the wind direction settings of the main outlets 32*a* to 32*d* has been entered. If a request for confirming the wind direction settings of the main outlets 32*a* to 32*d* has been entered, the sequence goes to step S120. On the other hand, the sequence goes to step S122 if a request for confirming the wind direction settings of the main outlets 32*a* to 32*d* has not been entered.

In step S120, it is determined if a request for individually setting the wind direction of any of the main outlets 32*a* to 32*d* has been entered. If a request for individually setting the wind direction of any of the main outlets 32*a* to 32*d* has been entered, the sequence goes to step S126 in FIG. 17. On the other hand, the sequence goes to step S100 if a request for individually setting the wind direction of any of the main outlets 32*a* to 32*d* has not been entered.

In step S122, the display section 85 displays the wind direction settings check screen D4, and the sequence goes to step S100.

<Wind Direction Individual Setting Operation>

Figure 17:
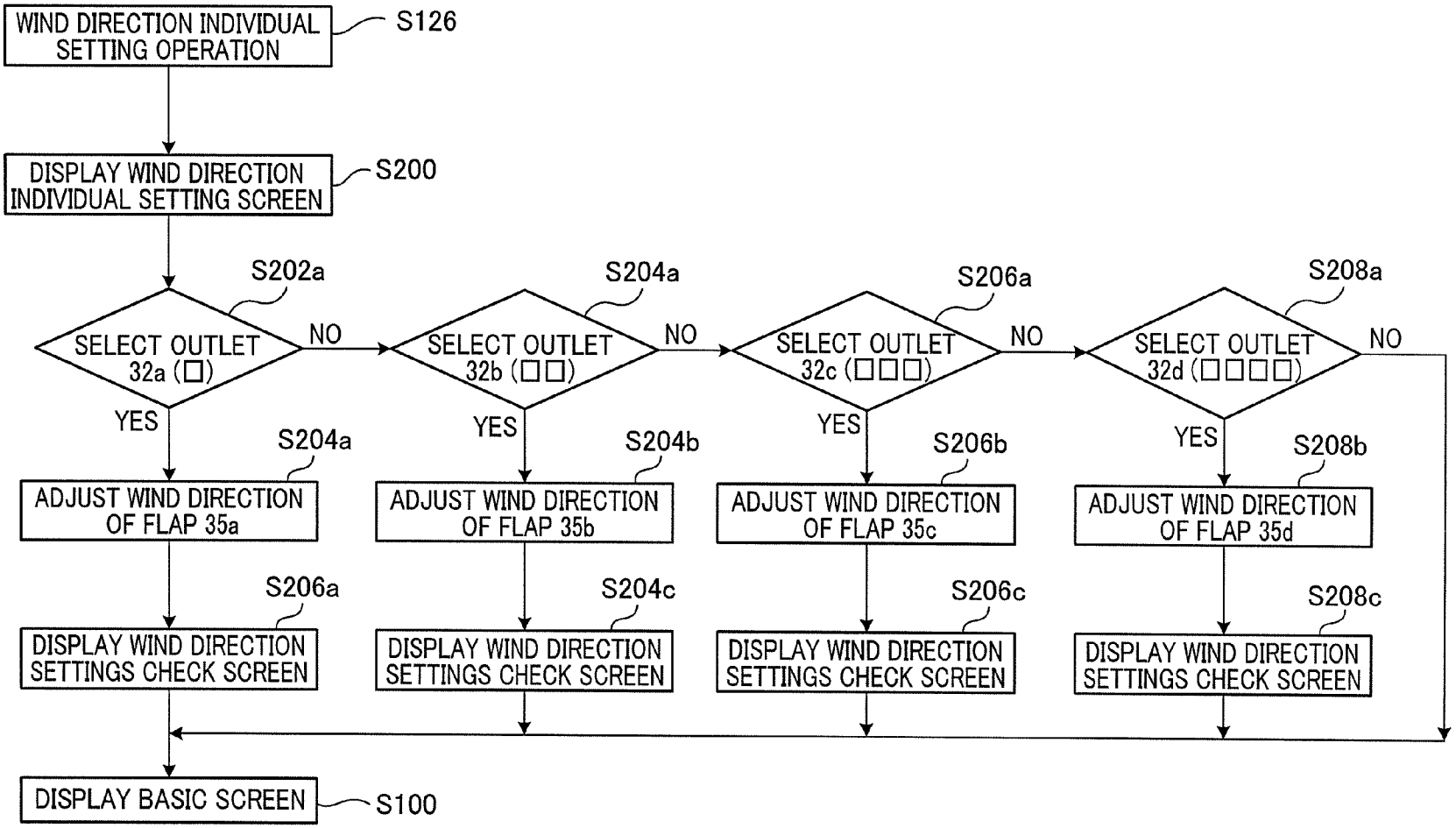
FIG. 17 is a flowchart representing the wind direction individual setting operation of the embodiment of the invention.

FIG. 17 is a flowchart representing the wind direction individual setting operation of the present embodiment.

Following step S126 in FIG. 17, the display section 85 in step S200 displays the initial screen D3-0 for wind direction individual setting (see FIG. 14(*a*)). In the next step S202*a*, it is determined whether the main outlet 32*a* has been selected. If the main outlet 32*a* has been selected, the sequence goes to step S204*a*, and the flap 35*a* is adjusted to the individually set wind direction. In step 206*a*, the display section 85 displays the wind direction settings check screen D4. If the main outlet 32*a* has not been selected, the sequence goes to step S202*b*. If the main outlet 32*b* has been selected, the wind direction of the flap 35*b* is adjusted in step S204*b*, and the wind direction settings check screen D4 is displayed in step S206*b*. The same process is performed for the main outlets 32*c* and 32*d* in steps S202*c* to S206*c* and in steps S202*d* to S206*d*, respectively.

In the foregoing wind volume/wind direction adjustment operation, the wind direction individual setting operation is performed in step S126 of FIG. 17 after the total wind volume adjustment operation (step S108) and the total wind direction adjustment operation (step S112) in FIG. 16. However, for example, the total wind volume adjustment operation (step S108) or the total wind direction adjustment operation (step S112) may be performed by interrupting the currently running wind direction individual setting operation when the wind volume/wind direction button 90 is pressed while performing the wind direction individual setting operation in step S126 of FIG. 17.

[Characteristics of the Air Conditioner of First Embodiment]

With the air conditioner of the first embodiment, pieces of information of all the main outlets 32*a* to 32*d* or the flaps 35*a* to 35*d* are simultaneously listed. A user, by looking at this list, can grasp the current settings of wind directions of all the main outlets 32*a* to 32*d* and the flaps 35*a* to 35*d* at once.

Further, in the indoor unit 1, different sign sections 60*a* to 60*d* are respectively formed in the vicinity of the plurality of main outlets 32*a* to 32*d*, and the display section 85 is capable of displaying information corresponding to the sign sections 60*a* to 60*d*. Therefore, the flap in need of, for example, wind direction change can be individually identified only by looking at the sign sections 60*a* to 60*d*. Further, with the display on the display section 85 corresponding to the sign sections 60*a* to 60*d*, the plurality of outlets 32*a* to 32*d* are easily recognized.

Further, a user can easily identify the sign sections 60*a* to 60*d*, because the sign sections 60*a* to 60*d* are three-dimensionally provided as recessed portions in the rim portions 50*a* to 50*d* of the panel lower surface portion 3*b*. Because the sign sections 60*a* to 60*d* are formed on the flat surface of the panel lower surface portion 3*b*, the sign sections 60*a* to 60*d* can easily be recognized from any direction in the room. Specifically, the recognition of the sign sections 60*a* to 60*d* from a certain direction in a room can be difficult when the sign sections 60*a* to 60*d* are formed on the outer side of the outlets and when the areas bearing the sign sections 60*a* to 60*d* are tilted with respect to the ceiling surface. It also can be difficult to recognize the sign sections 60*a* to 60*d* depending on the direction in a room when the flap angle is changed for flaps 35*a* to 35*d* having the sign sections 60*a* to 60*d* directly formed thereon.

Further, a user can individually identify the main outlets 32*a* to 32*d* and the flaps 35*a* to 35*d* more reliably, because the sign sections 60*a* to 60*d* are provided as figures "□" to "□□□□".

Further, a user can individually identify the main outlets 32*a* to 32*d* and the flaps 35*a* to 35*d* even more reliably, because the sign sections 60*a* to 60*d* corresponding to the main outlets 32*a* to 32*d* and the flaps 35*a* to 35*d* are formed by the counterclockwise layout of the figures "□" to "□□□□" representing the sign sections 60*a* to 60*d*.

Further, a user can individually identify the main outlets 32*a* to 32*d* and the flaps 35*a* to 35*d* even more reliably, because the surroundings of the sign sections 60*a* to 60*d* are matte finished to make the sign sections 60*a* to 60*d* more noticeable in appearance over the surroundings.

Further, because the decorative panel 3 and the sign sections 60*a* to 60*d* are integrally formed, it is not necessary to go through the laborious procedure of preparing four flaps of different shapes, which is otherwise necessary when a recessed sign section is to be provided for each flap. This reduces the number of manufacturing steps and the manufacturing cost of the air conditioner 1.

Further, the air-conditioning air can be sent into the room most efficiently, because the main outlets 32*a* to 32*d* are disposed on the panel side portions 30*a* to 30*d*, the outermost portions of the product.

Further, because the intake 31 is disposed on the inner side of the main outlets 32*a* to 32*d*, the discharged air flow can be prevented from being immediately drawn into the intake.

Further, because the sign sections 60*a* to 60*d* are formed on the intake 31 side of the main outlets 32*a* to 32*d*, the sign sections 60*a* to 60*d* can easily be checked even when the flaps 35*a* to 35*d* are moving during the operation.

Further, a user can easily identify the flaps 35*a* to 35*d* by looking at the sign sections 60*a* to 60*d*, even when the flaps 35*a* to 35*d* have substantially the same shape and make it difficult for the user to individually identify the flaps 35*a* to 35*d*.

Further, usability can be improved, because a user looking at the display section 85 of the wired remote control 83 can simultaneously grasp the main outlets 32*a* to 32*d* and the wind directions currently set for the outlets on the wind direction settings check screen D4.

Further, a user can easily grasp the wind directions of all the main outlets 32*a* to 32*d* only by looking at the display section 85, because the wind directions of the main outlets 32*a* to 32*d* are displayed in a list on the wind direction settings check screen D4.

Further, a user can change the wind direction positions of the flaps 35*a* to 35*d* with a remote control based on his or her memory of the sign sections corresponding to the outlets or flaps, even when the wired remote control 83 is disposed distant away from the indoor unit 1.

<Second Embodiment>

The indoor unit according to Second Embodiment of the present invention is described below with reference to the accompanying drawings.

[Basic Configuration of Indoor Unit]

Figure 18:
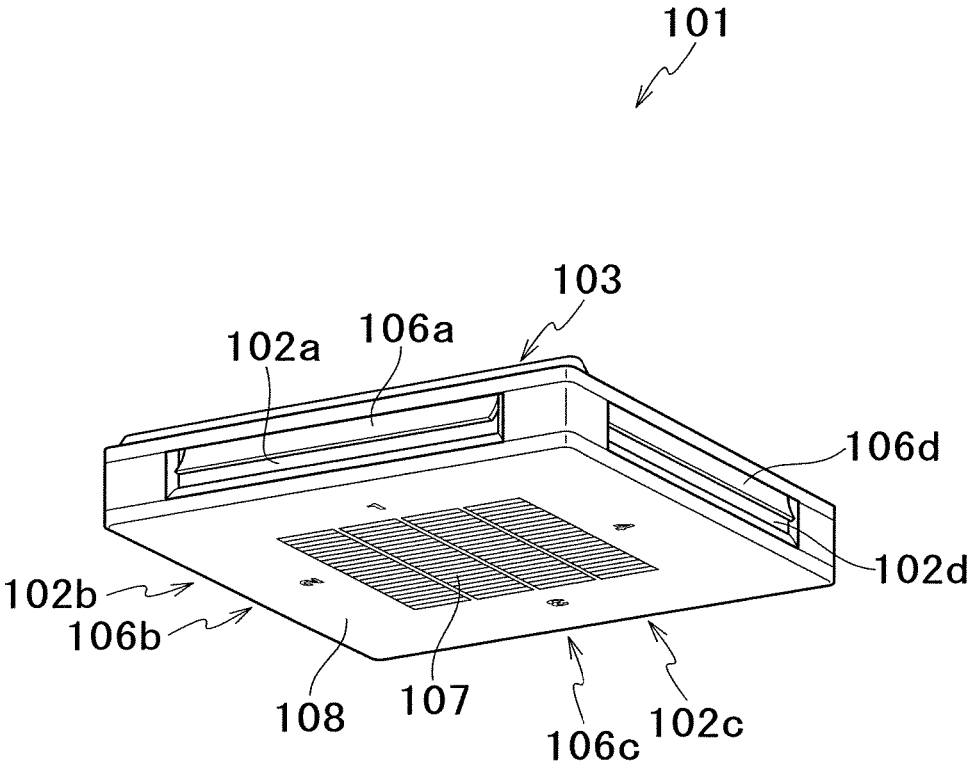
FIG. 18 is an external perspective view of the indoor unit according to Second Embodiment of the present invention.
Figure 19:
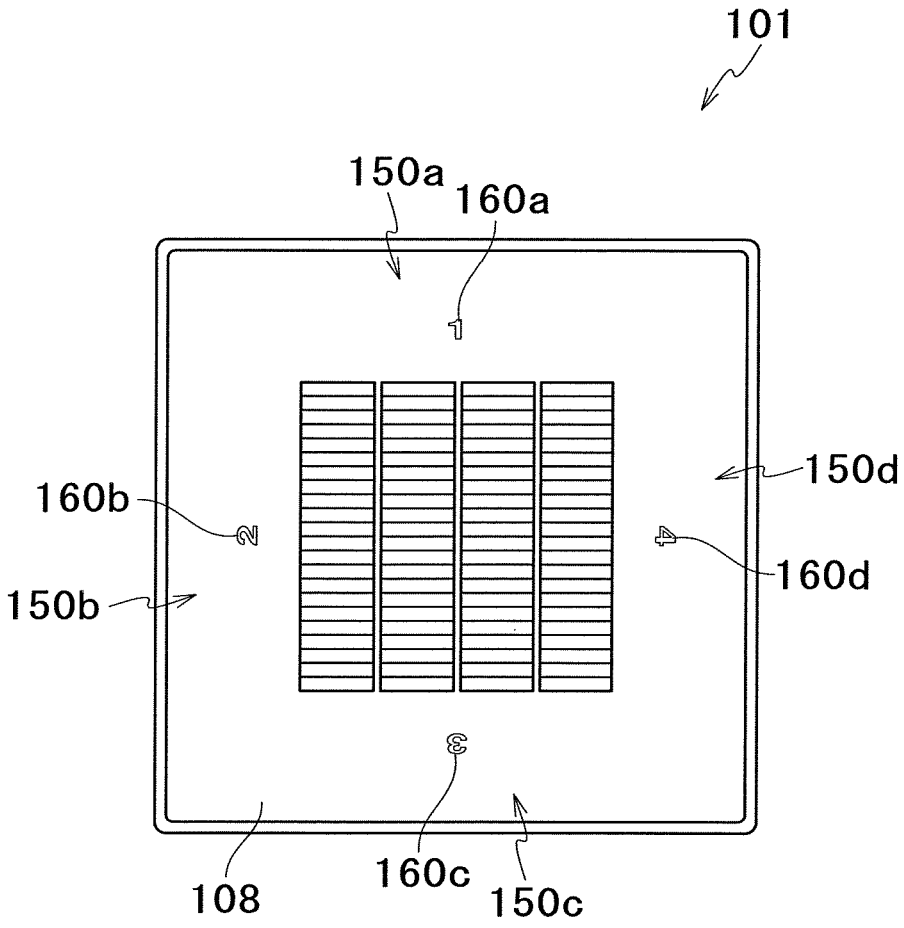
FIG. 19 is a plan view of a decorative panel of the indoor unit as viewed from an air-conditioned room.

FIG. 18 is an external perspective view of an indoor unit 101 according to Second Embodiment of the present invention. FIG. 19 is a plan view of an intake grill 108 of the indoor unit 101 as seen from the air-conditioned room.

As illustrated in FIG. 18, the indoor unit 101 is a ceiling-hanging indoor unit including box-shaped casing 103 provided with main outlets 102*a* to 102*d* provided as horizontal openings on the four sides of the casing 103. The indoor unit 101 is disposed on the ceiling surface (not illustrated). A heat exchanger and a turbo fan are housed inside the casing 103. Flaps 106*a* to 106*d* for adjusting the wind direction of the air-conditioning air into the room are rotatably provided for the main outlets 102*a* to 102*d*.

As illustrated in FIG. 18, the intake grill 108 having an intake 107 at the center is mounted on the lower surface of the casing 103 in a manner allowing the intake grill 108 to open and close. As illustrated in FIG. 19, the intake grill 108 has side portions 150*a* to 150*d* in the vicinity of the main outlets 102*a* to 102*d*, respectively. As illustrated in FIGS. 18 and 19, the main outlets 102*a* to 102*d* are formed along the side portions 150*a* to 150*d*, respectively. The intake 107 is disposed on the inner side of the main outlets 102*a* to 102*d*.

[Configuration of Sign Sections]

As illustrated in FIG. 19, the sign sections 160*a* to 160*d* for individually recognizing the main outlets 102*a* to 102*d* or the flaps 106*a* to 106*d* are formed by attaching stickers, numbered "1" to "4", to the side portions 150*a* to 150*d*. The numbers "1" to "4" correspond to the main outlets 102*a* to 102*d*, respectively, and are arranged in ascending order in the counterclockwise direction in FIG. 19. As illustrated in FIGS. 18 and 19, the sign sections 160*a* to 160*d* are formed on the intake 107 side of the main outlets 102*a* to 102*d*.

[Characteristics of the Air Conditioner of Second Embodiment]

In the air conditioner of Second Embodiment, the same effects obtained for the air conditioner of First Embodiment can be obtained, because the flaps in need of, for example, wind direction change can be individually identified from the flaps 106*a* to 106*d* only by looking at the sign sections 160*a* to 160*d* formed in the side portions 150*a* to 150*d* in the vicinity of the main outlets 102*a* to 102*d*.

Further, the sign sections 160*a* to 160*d* can easily be formed by attaching stickers numbered "1" to "4" to the side portions 150*a* to 150*d*.

<Third Embodiment>

The indoor unit according to Third Embodiment of the present invention is described below with reference to the accompanying drawings.

[Basic Configuration of Indoor Unit]

Figure 20:
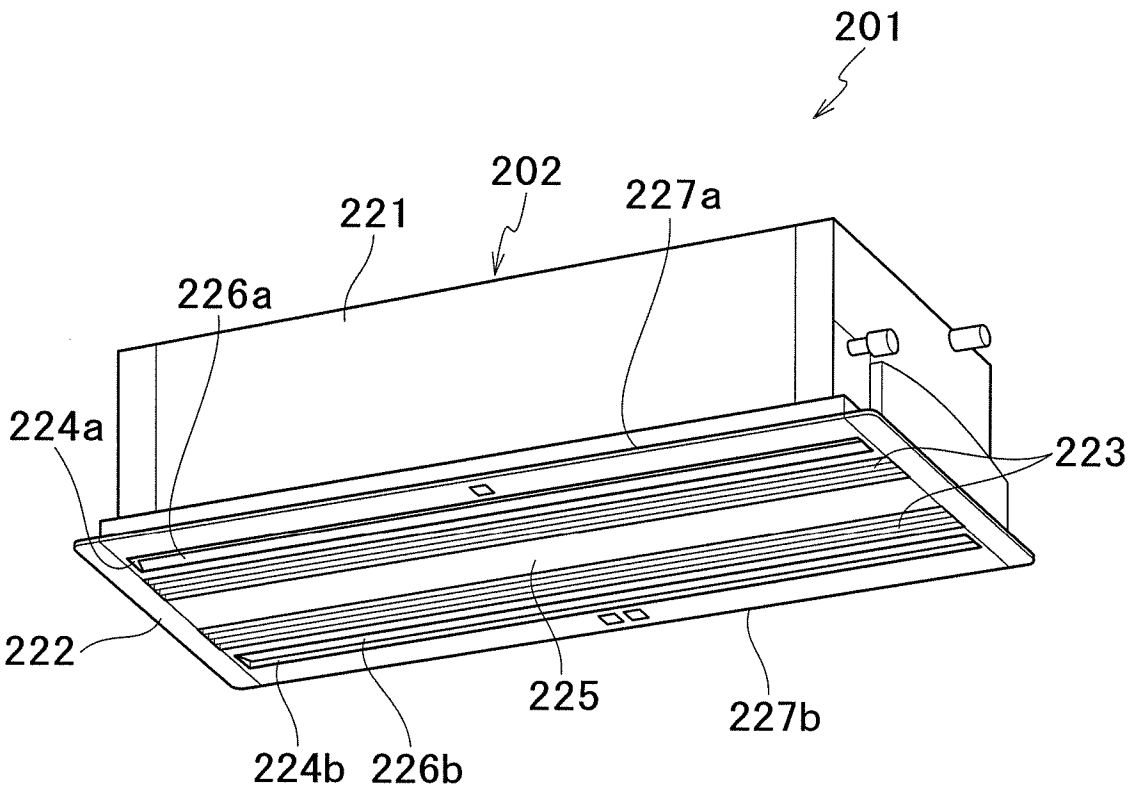
FIG. 20 is an external perspective view of the indoor unit according to Third Embodiment of the present invention.
Figure 21:
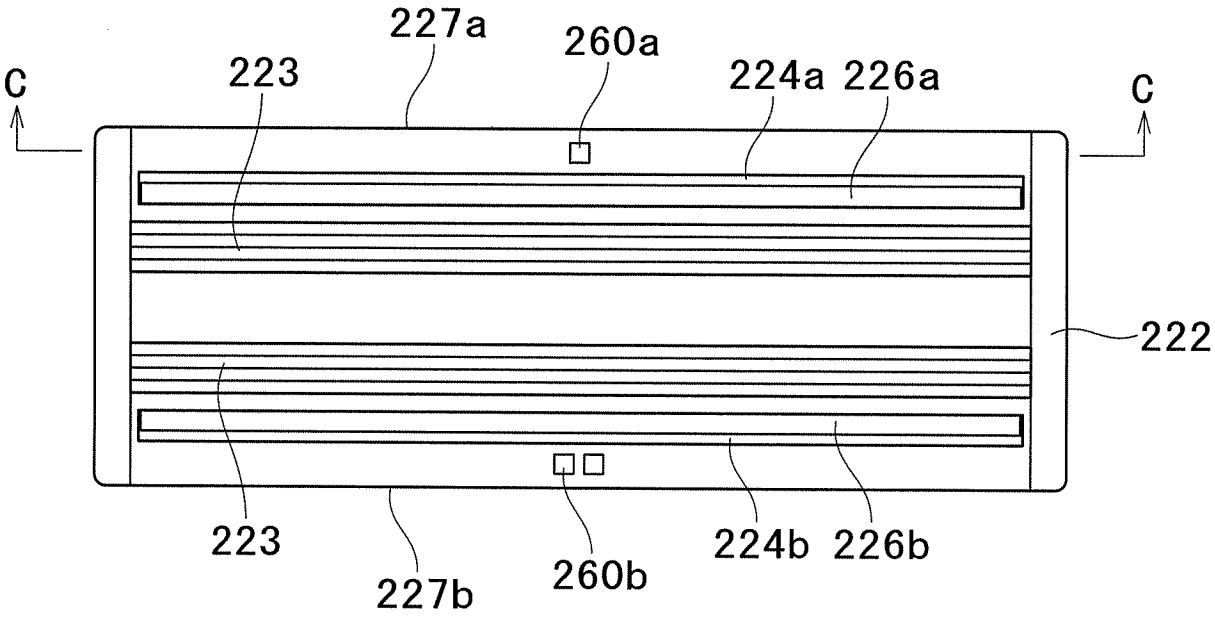
FIG. 21 is a plan view of a decorative panel of the indoor unit as viewed from an air-conditioned room.
Figure 22:
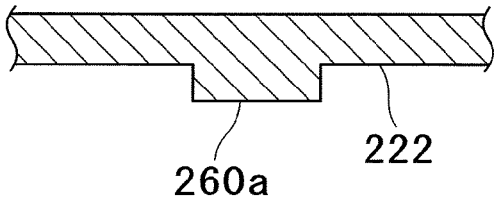
FIG. 22 is a cross sectional view taken at line C-C of FIG. 21.

FIG. 20 is an external perspective view of an indoor unit 201 according to Third Embodiment of the present invention. FIG. 21 is a plan view of a decorative panel 222 of the indoor unit 201 as viewed from the air-conditioned room. FIG. 22 is a cross sectional view taken at line C-C of FIG. 21.

The indoor unit 201 is a ceiling embedded indoor unit, and includes a casing 202 (FIG. 20) in which components such as a fan unit, a heat exchanger, and an electrical component box are contained. The casing 202 has a form of a horizontally long rectangle with a decorative panel 222 mounted on a main body casing 221. As illustrated in FIG. 20, the decorative panel 222 is detachably provided on the main body casing 221, covering the lower surface of the main body casing 221. Horizontally long intakes 223 are provided through the decorative panel 222 at the center, and horizontally long main outlets 224*a* and 224*b* are provided along side portions 227*a* and 227*b* on the both sides. Flaps 226*a* and 226*b* for adjusting the wind direction of the air-conditioning air into the room are rotatably provided for the main outlets 224*a* and 224*b*. As illustrated in FIG. 20, an intake grill 225 is detachably mounted on the intakes 223. The intakes 223 are disposed on the inner side of the main outlets 224*a* and 224*b*.

[Configuration of Sign Sections]

As illustrated in FIG. 21, sign sections 260*a* and 260*b* for individually recognizing the main outlets 224*a* and 224*b* and the flaps 226*a* and 226*b* are formed on the outer side of the decorative panel 222, in the vicinity of the main outlets 224*a* and 224*b*. The sign sections 260*a* and 260*b* are formed as the figures "□" and "□□". The figures "□" and "□□" correspond to the main outlets 224*a* and 224*b*, respectively. The sign sections 260*a* and 260*b* are formed opposite from the intakes 223 with respect to the main outlets 224*a* and 224*b*. As illustrated in FIG. 22, the sign sections 260*a* and 260*b* are three-dimensionally provided as raised portions on the decorative panel 222.

[Characteristics of the Air Conditioner of Third Embodiment]

In the air conditioner of Third Embodiment, the same effects obtained for the air conditioner of First Embodiment can be obtained, because the flaps in need of, for example, wind direction change can be individually identified from the flaps 226*a* and 226*b* only by looking at the sign sections 260*a* and 260*b* formed in the vicinity of the main outlets 224*a* and 224*b*.

While certain embodiments of the present invention have been described with reference to the accompanying drawings, it should be understood that specific configurations are not limited to the embodiments described above. Further, the scope of the present invention is defined not only by the descriptions of the foregoing embodiments but by the claims below, including all modifications within the meaning and scope of the equivalents to the claims.

<variation>

Figure 23:
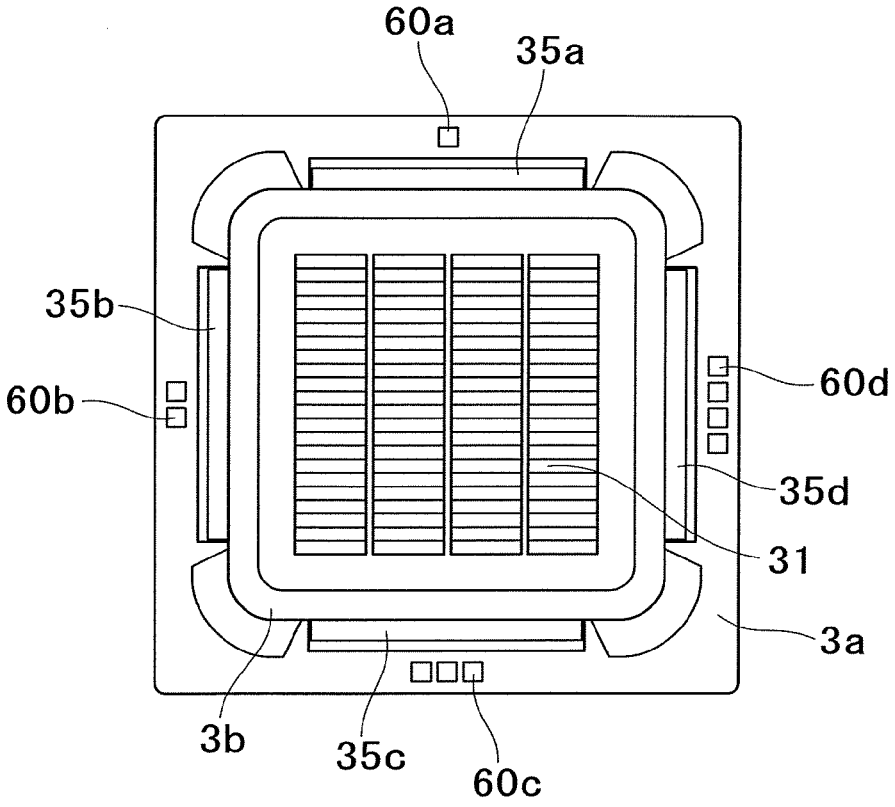
FIG. 23 is a diagram illustrating a variation of the indoor unit according to First Embodiment of the present invention.
Figure 24:
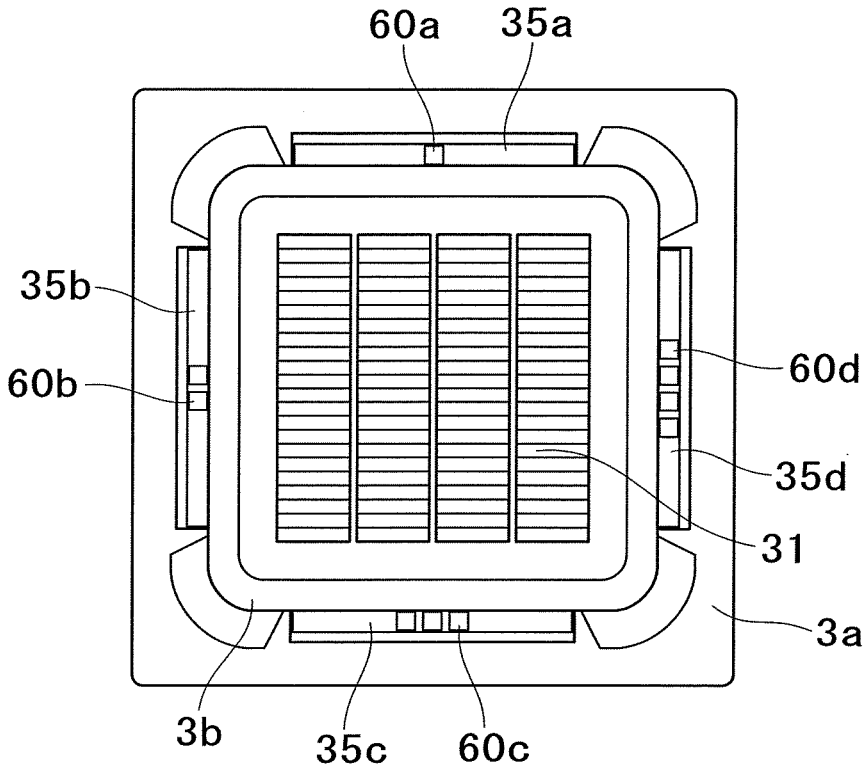
FIG. 24 is a diagram illustrating a variation of the indoor unit according to First Embodiment of the present invention.

In the foregoing First Embodiment, the sign sections are realized by the sign sections 60*a* to 60*d* formed as recessed portions in the rim portions 50*a* to 50*d*. In the foregoing Second Embodiment, the sign sections are realized by the sign sections 160*a* to 160*d* formed by attaching stickers numbered "1" to "4" to the side portions 150*a* to 150*d*. In the foregoing Third Embodiment, the sign sections are realized by the sign sections 260*a* and 260*b* formed as raised portions on the decorative panel 222. However, the present invention is not limited to these specific embodiments. For example, the outlets or flaps may be individually recognized by changing the color of each flap. Alternatively, as illustrated in FIG. 23, the sign sections 60*a* to 60*d* may be formed on the outer side of the outlets 32*a* to 32*d* on the panel main body 3*a*. Further, as illustrated in FIG. 24, the sign sections 60*a* to 60*d* may be directly formed on the flaps 35*a* to 35*d*.

In the foregoing First Embodiment, the sign sections 60*a* to 60*d* are described as being relatively glossier than the matte finished surroundings. However, the present invention is not limited to this embodiment. For example, the sign sections may be actively treated to be glossy, or may include a portion (gloss portion) where a luminous fluorescent coating that glows in the dark is applied. Further, the sign sections may be color displayed using, for example, an LED (light emitting portion), or an LED (light emitting portion) or other light emitting materials may be provided inside the transparent resin forming the flaps 35*a* to 35*d*.

In the foregoing First Embodiment, the sign sections 60*a* to 60*d* corresponding to the outlets 32*a* to 32*d* and the flaps 35*a* to 35*d* are described as being formed by the counterclockwise arrangement of the figures "□" representing the sign sections 60*a* to 60*d*. However, the present invention is not limited to this embodiment. For example, the sign sections 60*a* to 60*d* may be formed by the clockwise arrangement of the figures "□" representing the sign sections 60*a* to 60*d*. Further, the clockwise/counterclockwise layout may not even be necessary.

Further, in the foregoing First Embodiment, the present invention is described as being applied to the indoor unit 1 that includes the panel main body 3*a* provided with the main outlets 32*a* to 32*d* and the auxiliary outlets 32*e* to 32*h*. However, the present invention is not limited to this embodiment. For example, the present invention is also applicable to an indoor unit that includes a panel main body provided only with the main outlets 32*a* to 32*d*.

Further, in the foregoing First Embodiment, the indoor unit 1 is controlled by using the wired remote control 83 connected to the main body of the indoor unit 1 via the communication cable. However, the present invention is not limited to this embodiment. The air conditioner may be controlled by using a radio-transmission wireless remote control that does not make use of a communication cable for interconnection with the main body of the indoor unit 1.

Further, in the foregoing First Embodiment, the total wind volume of the outlets 32*a* to 32*d* is adjusted with a single fan motor 41 provided for the outlets 32*a* to 32*d*, and with a single impeller 42 that rotates by being joined to the fan motor 41. However, the present invention is not limited to this embodiment. For example, the wind volume may be individually adjusted for the outlets 32*a* to 32*d* with a fan motor and an impeller provided for each of the outlets 32*a* to 32*d*. When the wind volume is adjustable for each of the outlets 32*a* to 32*d*, the state of each wind volume of the outlets 32*a* to 32*d* may be displayed in a list in the display section 85. Further, when the operation mode (heating/cooling) is switchable for each of the outlets 32*a* to 32*d*, the operating condition for each of the outlets 32*a* to 32*d* may be displayed in a list in the display section 85.

Further, in the foregoing First Embodiment, the display region 105 is adapted to display "wind direction 1" to "wind direction 5" and "Swing". However, the present invention is not limited to this embodiment. For example, the display section 105 may display "Fully closed", indicating that the flaps are fully closed.

Further, in the foregoing First Embodiment, the wind direction of the main outlet 32*c* is set to "wind direction 1" in advance, and the wind direction positions of only the selected flaps 35*a*, 35*b*, and 35*d* are changed at once. However, the present invention is not limited to this embodiment. For example, the wind direction positions of the selected flaps 35*a*, 35*b*, and 35*d* may be directly changed without setting the wind direction of the main outlet 32*c* to "wind direction 1" in advance.

Further, in the foregoing First Embodiment, the remote control 83 and the indoor unit 1 are connected to each other via the communication cable W. However, the present invention is not limited to this embodiment. In the case of external power supply, the remote control may be connected to the outdoor unit via a wire, and the operation signals from the remote control may be sent first to the outdoor unit, and then to the indoor unit 1 with the supplied power from the outdoor unit.

Further, in the foregoing First Embodiment, wind direction settings check screen D4 simultaneously displays information indicative of the discharge directions of the air-conditioning air from the four main outlets 32*a* to 32*d*. However, the present invention is not limited to this embodiment. The wind direction settings check screen D4 may simultaneously display information (e.g., information indicative of the discharge directions of the air-conditioning air) of selected ones of the four main outlets 32*a* to 32*d* (two or three main outlets). Further, the wind direction settings check screen D4 may simultaneously display information (e.g., information indicative of the angles of the flaps) of all the four flaps 35*a* to 35, or simultaneously display information of selected ones of the four flaps 35*a* to 35*d* (two or three flaps). Further, the wind direction settings check screen D4 may simultaneously display information of selected ones of the four main outlets 32*a* to 32*d*, and information of selected ones of the four flaps 35*a* to 35*d*.

REFERENCE NUMERALS

1, 101, 201 Indoor unit
30*a* to 30*d* Panel side portions
31, 107, 223 Intake
32*a* to 32*d*, 102*a* to 102*d*, 224*a*, 224*b* Outlets
35*a* to 35*d*, 106*a* to 106*d*, 226*a*, 226*b* Flaps
60*a* to 60*d*, 160*a* to 160*d*, 260*a*, 260*b* Sign section
83 Wired remote control
85 Display section
87 Menu/set button (operation section)
88 Select button (operation section)
D0 Basic screen
D1 Main menu screen
D2 Total wind volume/total wind direction adjust screen
D3 Wind direction individual setting screen
D4 Wind direction settings check screen
U Ceiling surface
W Communication cable (wire)

The invention claimed is:

1. A controller configured to be used with an indoor unit that includes a plurality of flaps of substantially the same shape respectively disposed at a plurality of outlets, and capable of individually changing a discharge direction of air-conditioning air by changing a position of the flaps, the indoor unit including different sign sections which are respectively provided either in a vicinity of the plurality of outlets or on the plurality of flaps, the controller comprising:

an operation section configured to accept an operation entered to control the position of the flaps, and a display section configured to simultaneously display information, corresponding to two or more sign sections selected from the plurality of sign sections respectively provided either in the vicinity of the plurality of outlets or on the plurality of flaps, and information indicative of the discharge directions of the air conditioning air at the outlets indicated by the two or more sign sections.

2. The controller according to claim 1, wherein the operation section enables the positions of the plurality of flaps to be individually changed so as to change the discharge direction of the air-conditioning air at the plurality of outlets.

3. The controller according to claim 1, wherein the operation section enables the positions of the plurality of flaps to be changed at once so as to change the discharge direction of the air-conditioning air at the plurality of outlets.

4. The controller according to claim 3, wherein the operation section enables the positions of the selected ones of the plurality of flaps to be changed at once so as to change the discharge direction of the air-conditioning air at the plurality of outlets.

5. The controller according to claim 1, wherein the controller is connected to the indoor unit via a wire.

6. The controller according to claim 1, wherein the display section is configured to simultaneously display information indicative of the discharge directions of air-conditioning air at all of the plurality of outlets.

7. An air conditioner, comprising:

the controller according to any one of claims l, and 2 to 5; and the indoor unit.

8. The air conditioner according to claim 7, wherein the sign sections are three - dimensionally provided as raised portions or recessed portions.

9. The air conditioner according to claim 7, wherein the sign sections are provided by being printed or by attaching stickers.

10. The air conditioner according to claim 7, wherein the sign sections are provided as characters, figures, or combinations of characters and figures.

* * * * *